US010813524B2

(12) United States Patent
Harrington et al.

(10) Patent No.: US 10,813,524 B2
(45) Date of Patent: Oct. 27, 2020

(54) HARD SURFACE CLEANING DEVICES FOR USE WITH CLEANING FABRICS

(71) Applicant: Unger Marketing International, LLC, Bridgeport, CT (US)

(72) Inventors: William Harrington, Charlestown, RI (US); John A. Triunfo, Fairfield, CT (US); Paul Adams, Monroe, CT (US)

(73) Assignee: UNGER MARKETING INTERNATIONAL, LLC, Bridgeport, CT (US)

( * ) Notice: Subject to any disclaimer, the term of this patent is extended or adjusted under 35 U.S.C. 154(b) by 271 days.

(21) Appl. No.: 16/046,072

(22) Filed: Jul. 26, 2018

(65) Prior Publication Data

US 2018/0338663 A1 Nov. 29, 2018

Related U.S. Application Data

(63) Continuation of application No. PCT/US2016/068661, filed on Dec. 27, 2016.
(Continued)

(51) Int. Cl.
*A47L 13/256* (2006.01)
*A47L 13/258* (2006.01)
(Continued)

(52) U.S. Cl.
CPC ..... *A47L 13/256* (2013.01); *A47L 13/11* (2013.01); *A47L 13/12* (2013.01); *A47L 13/16* (2013.01);
(Continued)

(58) Field of Classification Search
CPC ..... A47L 13/256; A47L 13/11; A47L 13/12; A47L 13/16; A47L 13/254; A47L 13/258; A47L 13/46; A46B 5/0029
See application file for complete search history.

(56) References Cited

U.S. PATENT DOCUMENTS 3,465,377 A 9/1969 Thomas
3,792,505 A * 2/1974 Saltzstein ..... A47L 13/256 15/231
(Continued)

FOREIGN PATENT DOCUMENTS

GB 2411578 A 9/2005
JP 3626273 B2 3/2005
(Continued)

OTHER PUBLICATIONS

European Search Report for European Application No. 16888585.3, International Filing Date Jul. 18, 2018, dated Feb. 27, 2019, 8 pages.
(Continued)

*Primary Examiner* — Weilun Lo
(74) *Attorney, Agent, or Firm* — Cantor Colburn LLP

(57) ABSTRACT

A cleaning device for use with a cleaning fabric is provided. The device includes a plate, a connection member, a plurality of fingers, a wiper assembly, and a grip. The plate has a first side and a second side. The connection member retains the cleaning fabric to the plate. The fingers depend from the first side and provide a gap between the first side and the cleaning fabric during use. The wiper assembly has at least one elongated wiper blade that divides the fingers into a front section and a rear section. The grip depends from the second side.

24 Claims, 18 Drawing Sheets

Related U.S. Application Data

(60) Provisional application No. 62/288,522, filed on Jan. 29, 2016.

(51) Int. Cl.

| | |
|---|---|
| ***A47L 13/16*** | (2006.01) |
| ***A47L 13/254*** | (2006.01) |
| ***A47L 13/11*** | (2006.01) |
| ***A47L 13/46*** | (2006.01) |
| ***A47L 13/12*** | (2006.01) |
| *A46B 5/00* | (2006.01) |

(52) U.S. Cl.

CPC ..... *A47L 13/254* (2013.01); *A47L 13/258* (2013.01); *A47L 13/46* (2013.01); *A46B 5/0029* (2013.01)

(56) References Cited

U.S. PATENT DOCUMENTS

| | | | |
|---|---|---|---|
| 4,455,705 | A | 6/1984 | Graham |
| 4,852,210 | A | 8/1989 | Krajicek |
| 5,419,015 | A | 5/1995 | Garcia |
| 5,426,809 | A | 6/1995 | Muta |
| D429,545 | S | 8/2000 | Denney |
| D429,859 | S | 8/2000 | Denney |
| D429,860 | S | 8/2000 | Denney |
| D429,861 | S | 8/2000 | Denney |
| D430,716 | S | 9/2000 | Denney |
| D431,100 | S | 9/2000 | Denney |
| D435,710 | S | 12/2000 | Denney |
| D435,949 | S | 1/2001 | Denney |
| D436,702 | S | 1/2001 | Denney |
| D439,386 | S | 3/2001 | Denney |
| D446,367 | S | 8/2001 | Denney |
| D446,616 | S | 8/2001 | Denney |
| D446,895 | S | 8/2001 | Denney |
| D447,297 | S | 8/2001 | Denney |
| D447,299 | S | 8/2001 | Denney |
| D447,300 | S | 8/2001 | Denney |
| D447,610 | S | 9/2001 | Denney |
| D451,656 | S | 12/2001 | Denney |
| D452,053 | S | 12/2001 | Denney |
| 6,513,184 | B1 | 2/2003 | Brown |
| D503,836 | S | 4/2005 | Hall |
| D588,770 | S | 3/2009 | Koenig |
| 7,779,501 | B2 | 8/2010 | Lacotta |
| 7,854,035 | B2 | 12/2010 | Gullicks |
| D638,185 | S | 5/2011 | Yoon |
| D638,186 | S | 5/2011 | Yoon |
| D654,238 | S | 2/2012 | Lee |
| D655,876 | S | 3/2012 | Lee |
| 8,316,499 | B2 | 11/2012 | Dooley |
| 8,793,831 | B2 | 8/2014 | Katou |
| 8,869,338 | B1 | 10/2014 | Dooley |
| 9,055,852 | B2 | 6/2015 | Tuman |
| 2003/0084531 | A1 | 5/2003 | Dingert |
| 2004/0177461 | A1* | 9/2004 | Ajluni ..... A47L 13/12 15/121 |
| 2005/0061356 | A1 | 3/2005 | Wong |
| 2007/0056131 | A1 | 3/2007 | Dingert |
| 2007/0130710 | A1* | 6/2007 | Chen ..... A47L 13/12 15/115 |
| 2007/0130713 | A1* | 6/2007 | Chen ..... A47L 13/256 15/209.1 |
| 2007/0202768 | A1 | 8/2007 | Haskett |
| 2008/0060156 | A1* | 3/2008 | Michaels ..... A47L 1/06 15/121 |
| 2009/0144923 | A1 | 6/2009 | Tuman |
| 2009/0271937 | A1* | 11/2009 | Blom ..... A47L 13/11 15/114 |
| 2012/0096662 | A1* | 4/2012 | Uchiyama ..... A47L 13/26 15/160 |
| 2012/0195674 | A1* | 8/2012 | Mandle ..... A47L 13/22 401/138 |
| 2013/0104327 | A1* | 5/2013 | Borofsky ..... A47L 13/12 15/115 |
| 2013/0104328 | A1* | 5/2013 | Weaver ..... A46B 5/0054 15/119.1 |
| 2013/0180068 | A1* | 7/2013 | Pellegrino ..... A47L 13/12 15/114 |
| 2014/0007367 | A1 | 1/2014 | Soller |

FOREIGN PATENT DOCUMENTS

| | | |
|---|---|---|
| JP | 2016043082 | 4/2016 |
| LU | 88755 A1 | 10/1996 |

OTHER PUBLICATIONS

International Search Report dated Mar. 30, 2017 for corresponding PCT/US16/68661, 2 pages.

Written Opinion of the International Searching Authority dated Mar. 30, 2017 for corresponding PCT/US16/68661, 10 pages.

International Preliminary Report on Patentability dated Jul. 31, 2018 for corresponding PCT/US16/68661, 11 pages.

* cited by examiner

| | FIGS. 9B AND 10B | FIGS. 9A AND 10A |
|---|---|---|
| DUST LEADING EDGE | 6.7 GRAMS | 4.3 GRAMS |
| DUST PICKED UP | 4.9 GRAMS | 4.4 GRAMS |

| | FIG. 6 | FIG. 26 |
|---|---|---|
| AMOUNT OF DUST COLLECTED BY TEXTILE (GRAMS) | 2.9 GRAMS | 3.0 GRAMS |
| AMOUNT OF DUST PUSHED OFF END (GRAMS) | 3.6 GRAMS | 4.9 GRAMS |
| AMOUNT OF DUST REMAINING ON SURFACE (GRAMS) | 2.6 GRAMS | 1.2 GRAMS |

HARD SURFACE CLEANING DEVICES FOR USE WITH CLEANING FABRICS

CROSS REFERENCE TO RELATED APPLICATIONS

This application is a continuation of International Application No. filed on PCT/US16/68661 filed on Dec. 26, 2016, which claims the benefit of U.S. Provisional Application No. 62/288,522 filed on Jan. 29, 2016, the entire contents of all of which are incorporated herein by reference.

BACKGROUND OF THE INVENTION

1. Field of the Invention

The present disclosure is related to hard surface cleaning devices. More particularly, the present disclosure is related to hard surface cleaning devices for use with cleaning fabrics.

2. Description of Related Art

Hard surface cleaning devices that use cleaning fabrics, in wet or dry conditions, to clean are well known. The cleaning fabrics can include cotton cloths, microfiber cloths, and other woven or knit fabrics. Additionally, the cleaning fabrics can include non-woven cleaning fabrics such as, but not limited to, Swiffer® cleaning sheets commercially available from the Procter & Gamble Company and the 3M™ Easy Trap Duster traps commercially available from The 3M Company.

These various types of cleaning fabrics have been used with many different types of devices such as, but not limited to, hand held surface cleaners, floor cleaners, mops, and others.

It has been determined by the present disclosure that there is a desire for the cleaning devices to be configured to maximize the amount of dust and/or debris ("debris") that is collected by the cleaning fabric during use.

Advantageously, the cleaning devices of the present disclosure are configured to improve and/or maximize the debris collection of cleaning fabrics.

SUMMARY

Cleaning devices are provided for use with cleaning fabrics, were the devices are configured to maximize the amount of debris that goes into and throughout the thickness, length, and width of the fabric. In some embodiments, the cleaning devices allow for a reduction in the amount of cleaning fabric that is used without negatively effecting cleaning efficiency.

A cleaning device for use with a cleaning fabric is provided. The device includes a plate, a connection member, a plurality of fingers, a wiper assembly, and a grip. The plate has a first side and a second side. The connection member retains the cleaning fabric to the plate. The fingers depend from the first side and provide a gap between the first side and the cleaning fabric during use. The wiper assembly has at least one elongated wiper blade that divides the fingers into a front section and a rear section. The grip depends from the second side.

In some embodiments either alone or in combination with one or more of the afore and/or after mentioned embodiments, the first side includes the connection member that retains the cleaning fabric.

In some embodiments either alone or in combination with one or more of the afore and/or after mentioned embodiments, the wiper assembly has one elongated wiper blade for each of the front and rear sections.

In some embodiments either alone or in combination with one or more of the afore and/or after mentioned embodiments, the connection member is on the first side between the elongated wiper blades of the front and rear sections.

In some embodiments either alone or in combination with one or more of the afore and/or after mentioned embodiments, the elongated wiper blades are angled outward with respect to the connection member.

In some embodiments either alone or in combination with one or more of the afore and/or after mentioned embodiments, the elongated wiper blades are angled outward with respect to a vertical by between 5 degrees and 70 degrees.

In some embodiments either alone or in combination with one or more of the afore and/or after mentioned embodiments, the elongated wiper blades are angled outward with respect to a vertical by between 10 degrees and 30 degrees.

In some embodiments either alone or in combination with one or more of the afore and/or after mentioned embodiments, the elongated wiper blades have an undeflected height that is larger than an undeflected height of the fingers by from 0% to 35%.

In some embodiments either alone or in combination with one or more of the afore and/or after mentioned embodiments, the undeflected height of the elongated wiper blades is larger than the undeflected height of the fingers by 5% and 20%.

In some embodiments either alone or in combination with one or more of the afore and/or after mentioned embodiments, the connection member is recessed with respect to the undeflected height of the fingers.

In some embodiments either alone or in combination with one or more of the afore and/or after mentioned embodiments, the cleaning device also includes a debris collection area between the fingers and the elongated wiper blades.

In some embodiments either alone or in combination with one or more of the afore and/or after mentioned embodiments, the elongated wiper blades have a durometer equal to or greater than a durometer of the fingers.

In some embodiments either alone or in combination with one or more of the afore and/or after mentioned embodiments, the elongated wiper blade has a durometer equal to or greater than a durometer of the fingers.

In some embodiments either alone or in combination with one or more of the afore and/or after mentioned embodiments, the front and rear sections are configured to provide a symmetrical profile to the wiper assembly.

In some embodiments either alone or in combination with one or more of the afore and/or after mentioned embodiments, the connection member is recessed with respect to an end of the fingers.

In some embodiments either alone or in combination with one or more of the afore and/or after mentioned embodiments, the connection member is recessed with respect to an end of the elongated wiper blade.

In some embodiments either alone or in combination with one or more of the afore and/or after mentioned embodiments, the connection member includes a plurality of molded spikes.

In some embodiments either alone or in combination with one or more of the afore and/or after mentioned embodiments, the elongated wiper blade has a durometer equal to or greater than a durometer of the fingers.

A cleaning device for use with a cleaning fabric is also provided that includes a plate having a front section, a connection member, and a rear section thereon. The connection member releasably retains the cleaning fabric to the plate. The front and rear sections each have a plurality of fingers depending from the first side. The front and rear sections are divided by at least one elongated wiper blade. The fingers and elongated wiper blade provide a gap between the plate and the cleaning fabric during use.

In some embodiments either alone or in combination with one or more of the afore and/or after mentioned embodiments, the front and rear sections each include the elongated wiper blade.

In some embodiments either alone or in combination with one or more of the afore and/or after mentioned embodiments, the connection member is positioned between the elongated wiper blade of the front and rear sections, respectively.

In some embodiments either alone or in combination with one or more of the afore and/or after mentioned embodiments, the connection member is recessed with respect to the elongated wiper blades and/or the fingers.

In some embodiments either alone or in combination with one or more of the afore and/or after mentioned embodiments, the elongated wiper blades are angled outward with respect to the connection member.

In some embodiments either alone or in combination with one or more of the afore and/or after mentioned embodiments, the elongated wiper blades are angled outward by between 5 degrees and 70 degrees.

In some embodiments either alone or in combination with one or more of the afore and/or after mentioned embodiments, the elongated wiper blades are angled outward by between 10 degrees and 30 degrees.

In some embodiments either alone or in combination with one or more of the afore and/or after mentioned embodiments, the front and rear sections further include a debris collection area defined between the fingers and the elongated wiper blade.

In some embodiments either alone or in combination with one or more of the afore and/or after mentioned embodiments, the front and rear sections are symmetrical to one another.

In some embodiments either alone or in combination with one or more of the afore and/or after mentioned embodiments, the elongated wiper blade has an undeflected height that is larger than an undeflected height of the fingers by from 0% to 35%.

In some embodiments either alone or in combination with one or more of the afore and/or after mentioned embodiments, the connection member is recessed with respect to the elongated wiper blade and/or the fingers.

In some embodiments either alone or in combination with one or more of the afore and/or after mentioned embodiments, the elongated wiper blade has a durometer equal to or greater than a durometer of the fingers.

The above-described and other features and advantages of the present disclosure will be appreciated and understood by those skilled in the art from the following detailed description, drawings, and appended claims.

DETAILED DESCRIPTION

Figure 1:
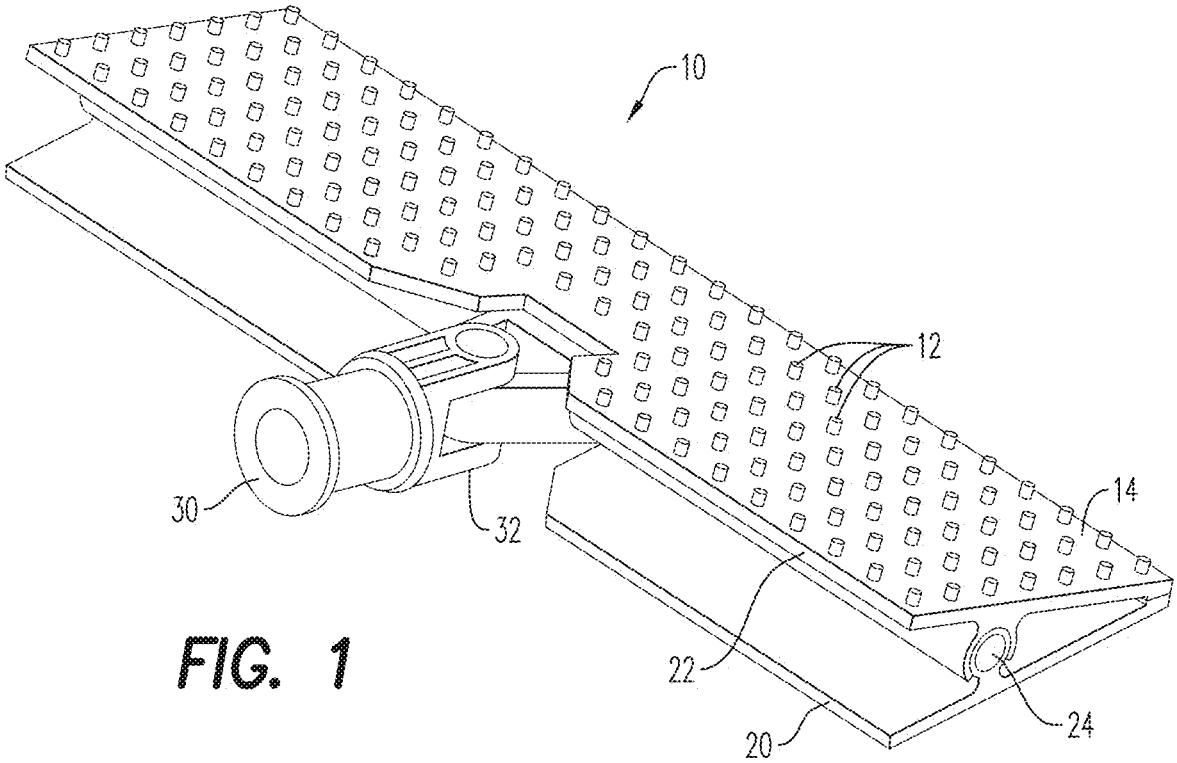
FIG. 1 is a bottom perspective view of an exemplary embodiment of a cleaning device according to the present disclosure.
Figure 2:
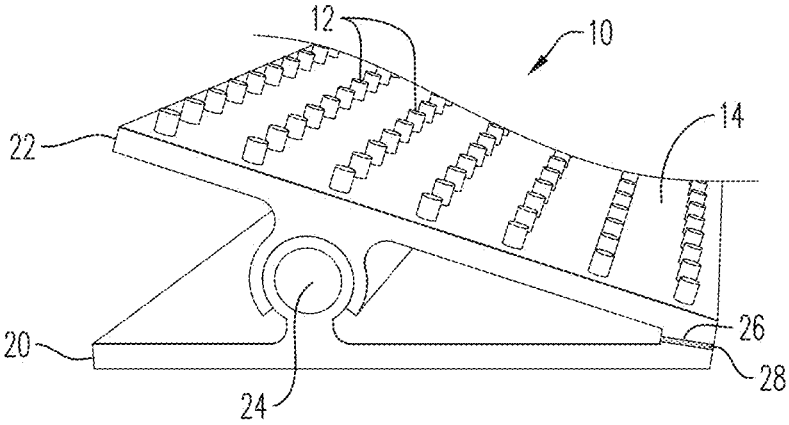
FIG. 2 is a magnified end view of the cleaning device of FIG. 1.
Figure 3:
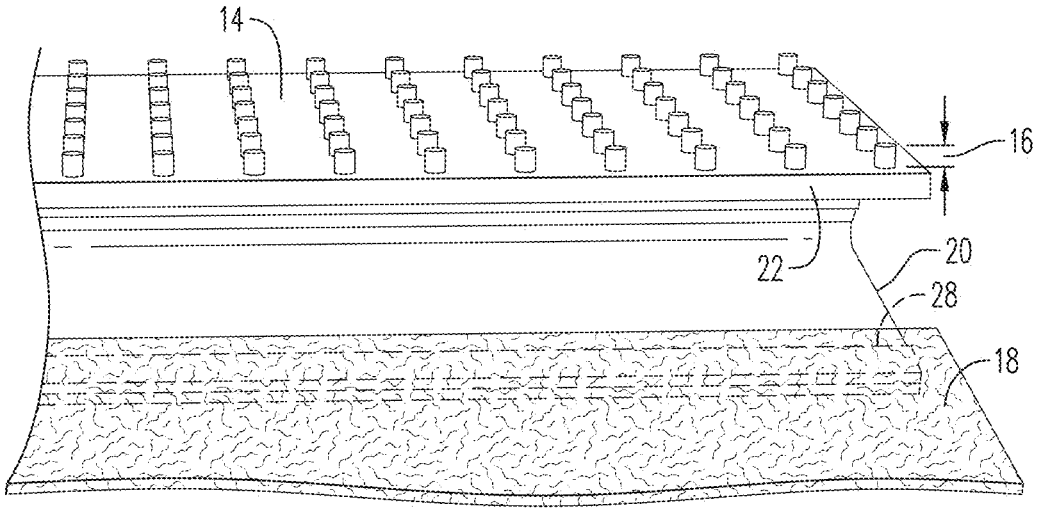
FIG. 3 is a front view of the cleaning device of FIG. 1 during a first fabric installation step.
Figure 4:
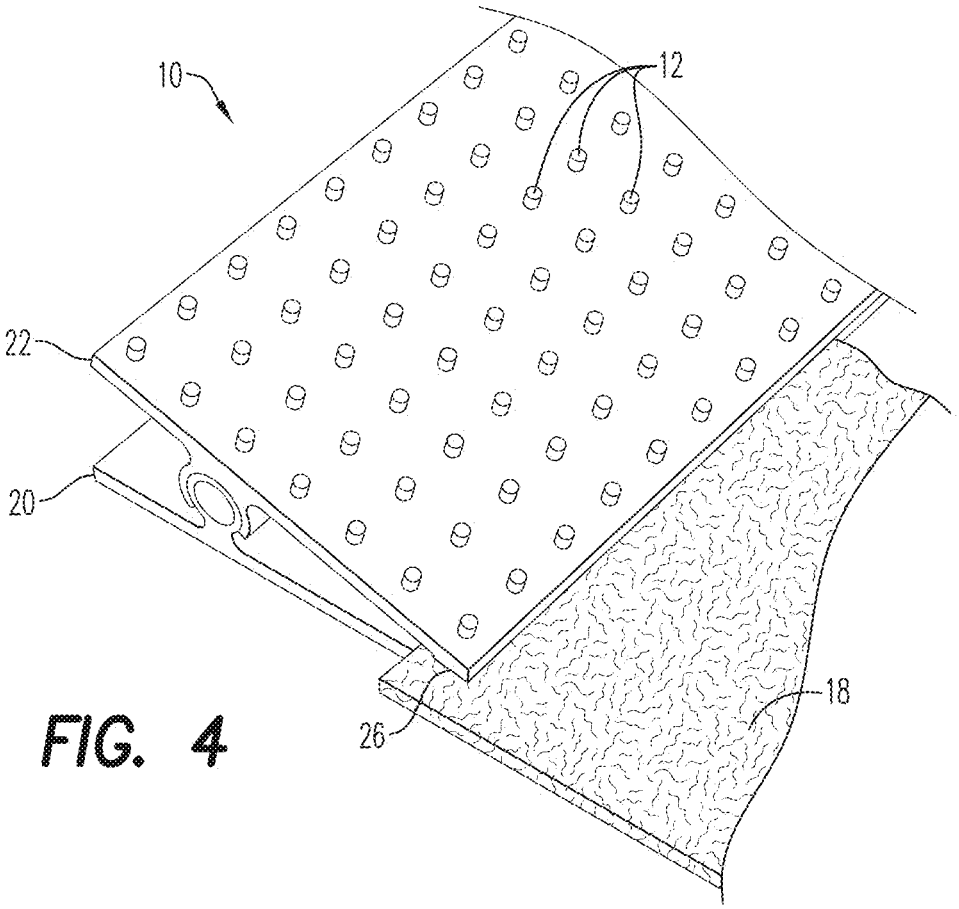
FIG. 4 is a bottom view of the cleaning device of FIG. 1 during a second fabric installation step.
Figure 5:
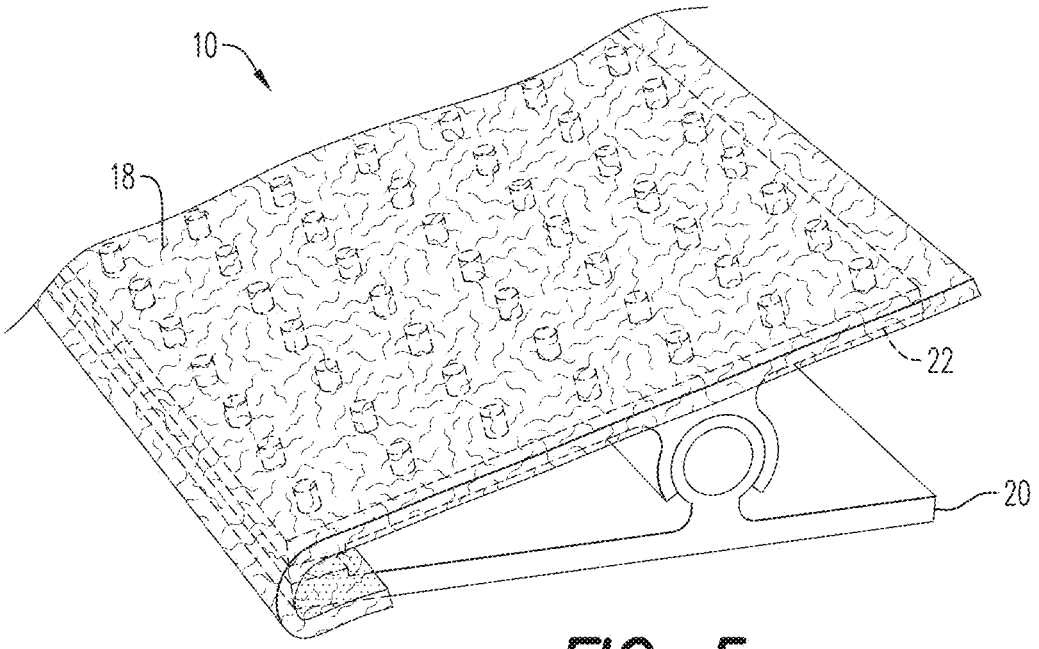
FIG. 5 is a bottom view of the cleaning device of FIG. 1 after installation of the fabric.

Referring to the drawings and in particular to FIGS. 1 through 5, an exemplary embodiment of a cleaning device according to the present disclosure is shown and is generally referred to by reference numeral 10. Device 10 can be a hand-held surface cleaner, a floor cleaner, a mop, and others. Moreover, device 10 can be used in wet or dry conditions, as well as with pretreated cleaning fabrics, as are known in the art.

Device 10 includes a plurality of fingers 12, which provide a gap or space 16 between a surface 14 of the device and a woven cleaning fabric 18. Fabric 18 is preferably a non-woven cleaning cloth that has a lofted thickness with an open or porous structure between non-woven fibers. In some embodiments, fabric 18 can have a coating on the fibers that improve debris collection and retention. In other embodiments, fabric 18 can be pretreated with a cleaning solution. For ease of discussion, device 10 is discussed herein in use with fabric 18 in the form of the 3M™ Easy Trap Duster traps commercially available from The 3M Company. Of course, it is contemplated by the present disclosure for device 10 to find use with any other woven, knit, or non-woven cleaning fabrics that have a lofted thickness with an open or porous structure.

Without wishing to be bound by any particular theory, fingers 12 are believed to provide support for fabric 18 in a resilient manner that maximizes contact of the fabric to the surface being cleaned during use over uneven surfaces and grout lines, which is believed to maximize debris collection. Fingers 12 have a length, cross-sectional dimension, and spacing that is believed to be sufficient to provide multiple pathways for debris to travel past a leading edge, as determined by the cleaning direction, of fabric 18 along a width and/or length of the fabric. Fingers 12 are believed to be sufficient to support for fabric 18 in a manner sufficient to maintain gap 16 between surface 14 and the fabric during use, which is believed to enhance or improve the flow of debris into the thickness of the fabric.

Advantageously, device 10 is believed to provide a higher debris pickup per unit area, with the flow of debris into the length and/or width and/or thickness being improved so as to ensure that the debris enters the fabric in multiple directions. As a result, device 10 is believed to eliminate the need to flip or turn fabric 18 over during use in order to be fully utilized, which allows the device to both simplify the user experience.

Broadly, fingers 12 have sufficient resiliency to flex and conform, yet maintain the desired gap 16—which may be as large as the normal height of the fingers, but due to flexion of the fingers may be less than the normal height of the fingers. The resiliency of fingers 12 is provided by height of the fingers, the spacing between the fingers, the cross-sectional area of the fingers, the material of the fingers, and others. Fingers 12 are contemplated by the present disclosure to be made of materials such as, but not limited to, thermoplastic elastomer rubber (TPR), thermoplastic elastomer (TPE), polyurethane (PU), natural rubber, silicone, polyvinyl chloride (PVC), and others.

Fingers 12 can have any desired cross section, but in many embodiments have a circular cross section. Fingers 12 are preferably patterned on device 10 in a manner that provides a tortious path from the leading edge to the trailing edge. Patterns that have been determined by the present disclosure to provide the desired path include, but art not limited to, checkerboard patterns, alternating patters, and others.

Fingers 12 are flexible and have a density, in number of fingers per square inch, and length that provide the desired resiliency. In some embodiments, fingers 12 can have a durometer of between Shore 20A and Shore 90A, preferably between Shore 30A and Shore 70A, with Shore 50A being most preferred, and any subranges there between. Fingers 12 can have an aspect ratio of between 100:1 and 1:1, preferably between 50:1 and 2:1, more preferably between 15:1 and 5:1, with between 10:1 to 5:1 being the most preferred, and any subranges there between. Fingers 12 can have a density, in fingers per square inch, of between 5 and 100, preferably between 10 and 70, more preferably between 20 and 50, with between 30 and 40 being the most preferred, and any subranges there between.

In the embodiment of FIGS. 1-5, device 10 includes a pair of plates 20, 22 that are connected to one another in a biased manner at a pivot 24. Device 10 is configured to secure fabric 18 between plates 20, 22 at a pinch point 26 formed by the biasing of the plates towards one another by pivot 24.

Additionally, or in place of pinch point 26, device 10 can include a connection member 28 on one or more of plates 20, 22. In some embodiments, connection member 28 can be teeth or spikes molded into or secured to plates 20 and/or 22 that can grab or secure fabric 18. In other embodiments, connection member 28 can be one side of a hook-and-loop type fastener that can grab or secure fabric 18 directly. Hook-and-loop fasteners sufficient for use as connection member 28 can include, but are not limited to, microfiber fabrics, Velcro® brand fasteners that are commercially available from Velcro Industries B.V, and others.

Device 10 can include grip 30 and, in some embodiments, a joint 32 to increase the ease of use and movement during cleaning. In some embodiments, grip 30 can be an extension pole or a handle. In some embodiments, joint 32 can be a pivot joint.

Figure 6:
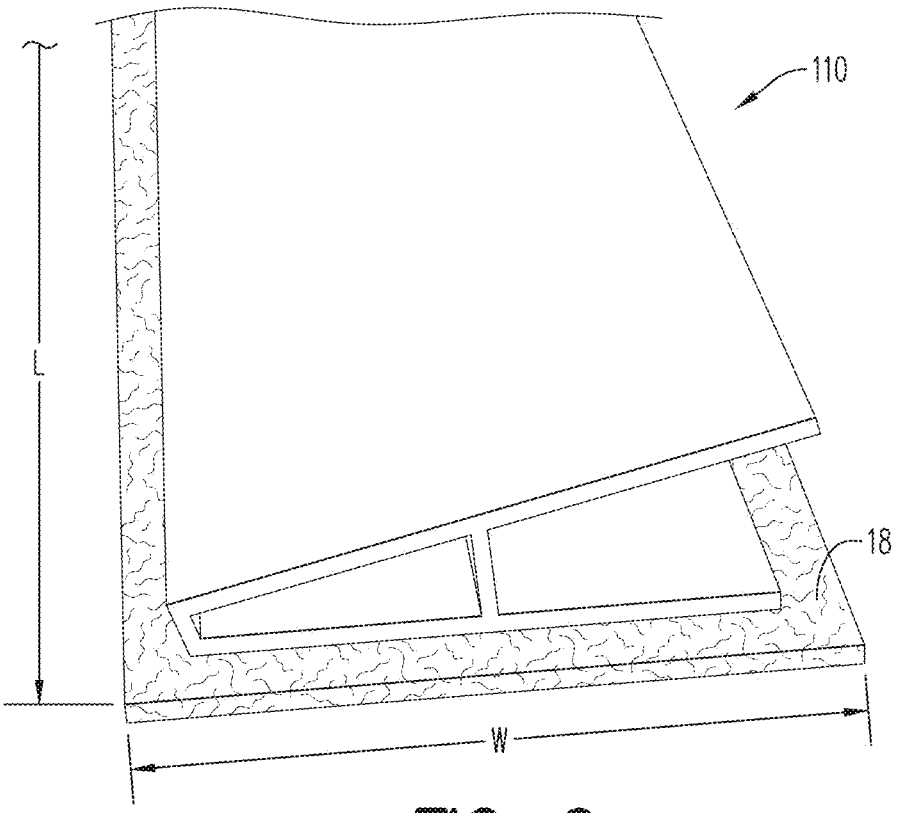
FIG. 6 (PRIOR ART)
FIG. 6 is a top view of a prior art cleaning device.

A prior art cleaning device 110 is shown in FIG. 6 in use with fabric 18. Here, it can be seen that the prior art device 110 lacks fingers 12 discussed above with respect to the present application. Device 110 is shown in use with fabric 18 that has a width (W) of 5 inches and a length (L) of 23 inches.

Figure 7:
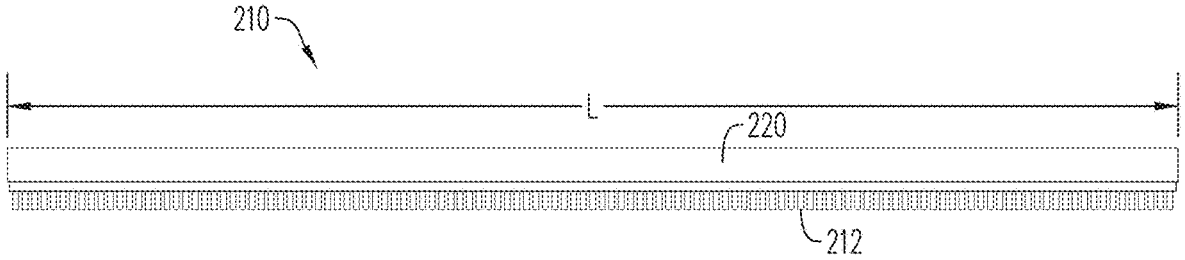
FIG. 7 is a side view of a second alternate exemplary embodiment of a cleaning device according to the present disclosure.
Figure 8:
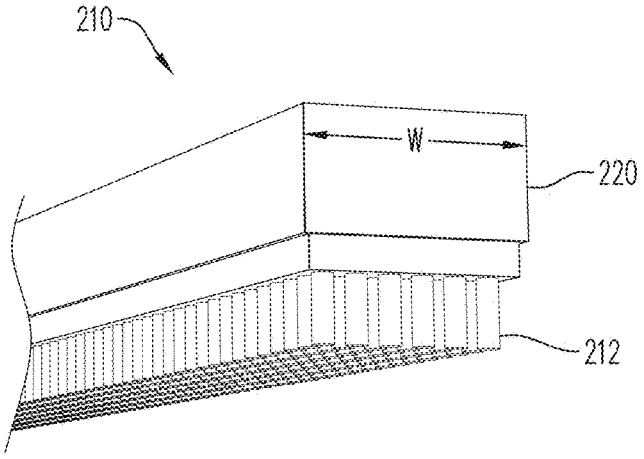
FIG. 8 is a magnified end view of the cleaning device of FIG. 7.

To compare the debris collection capabilities of the prior art device 110 and those of the present application, a test was performed with the prior art device 110 having fabric 18 and an exemplary embodiment of the device the present application, illustrated in FIGS. 7 and 8, and referred to by reference numeral 210.

Device 210 includes a single plate 220 having fingers 212 depending therefrom. Device 210 is configured for use with fabric 18 that has a length (L) identical to that used by prior art device 110 (i.e., 23 inches), but is configured for use with a fabric width (W) that is approximately one half of that used by the prior art device 110 (i.e., 2.5 inches).

Devices 110 and 210 were then tested as follows. A test surface consisting of a raised area of vinyl flooring, 48"×96" in dimension, was cleaned and prepared for testing.

A desired quantity of debris was prepared by mixing various quantities of commercially available test material of differing sizes (i.e., course, medium, and fine) so as to approximate common residential or commercial cleaning debris. Test debris is commercially available from companies such as, but not limited to, Power Technologies Inc. and include materials such as, but not limited to, ISO Test Dust, Arizona Test Dust Fractions, Aramco Test Dust, JIS Test Dust, ASHRAE Test Dust, Quartz Test Contaminants, Military Standards Test Dust Contaminants, and others. Thus, the test debris can include any combination of materials such as, but not limited to, ISO 12103-1 Test Dust Grades, ISO 12103-1, A1 Ultrafine Test Dust, ISO 12103-1, A2 Fine Test Dust, ISO 12103-1, A3 Medium Test Dust, ISO 12103-1, A4 Coarse Test Dust, 0-Specified Test Dust Grades, Intermediate Test Dust Grades, Typical Chemical Analysis for Arizona Test Dust Products, Miscellaneous Test Dust Grades, 90% Arizona Test Dust, 10% Salt, JIS Z8901 Classes 7, 8 & 11 Kanto Loam Test Dusts, Product List JIS II—Classes 1, 2 & 3, Product List JIS 5—Class 5, ASHRAE Test Dust #2 Per ANSI/ASHRAE 52.2P, ASHRAE Test Dust #1 Per ANSI/ASHRAE 52.1 and 52.2, Graded Crushed Quartz Fractions, Quartz, Gypsum, Calcite, Salt Blend, ECE R16 Quartz Test Dust, Custom Quartz Distributions Upon Request, MIL E-5007 and MIL-AV-E-8593F, MIL-STD-810E Silica Dust and Silica Sand, MIL-STD-810G Blowing Dust and Blowing Sand, AFRL 03 TEST DUST, AFRL 02 TEST DUST, CHINA DUST, EMS 452 TEST DUST MIX, Fly Ash, Talc Powder, Portland Cement, Carbon Black, Olivine Sand, and others.

Two 20-gram amounts of the desired test debris were weighed out. Fabric 18 was then cut to size for each prior art device 110 (i.e., 5"×23") and device 210 (2.5"×23"), with each fabric being weighed for use in determining the weight of debris collected by the test.

The debris mixture was spread onto the cleaned and dried test surface. Device 110 was placed on the test surface and was then moved over the debris without applying additional pressure to the device (e.g., using only the weight of device 110—including the grip). After passing over the debris, the device 110 was pushed to the end of the test surface with any debris collected in front of the device being pushed off of the test surface onto a collection plate.

The test was repeated for device 210 and the debris on the collection plate and the fabric 18, with debris collected therein, were then weighed for each test.

Figure 9A:
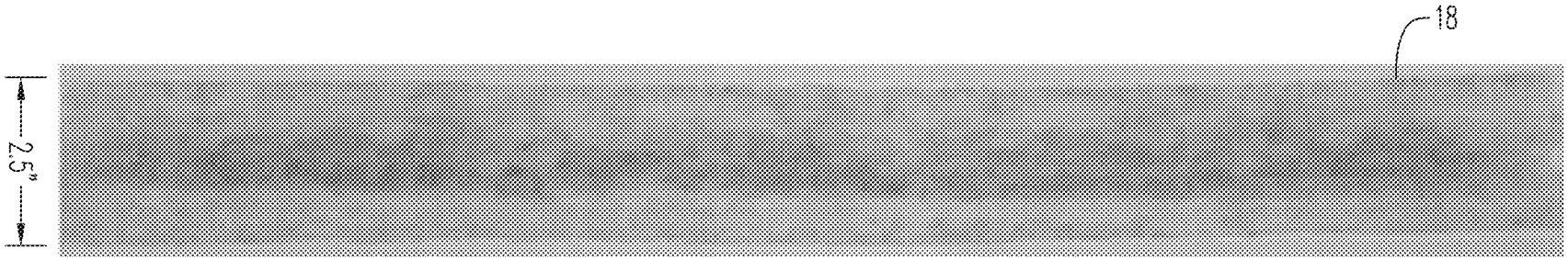
FIG. 9*a* illustrates the floor side of a cleaning fabric after use in the cleaning device of FIGS. 7-8.
Figure 9B:
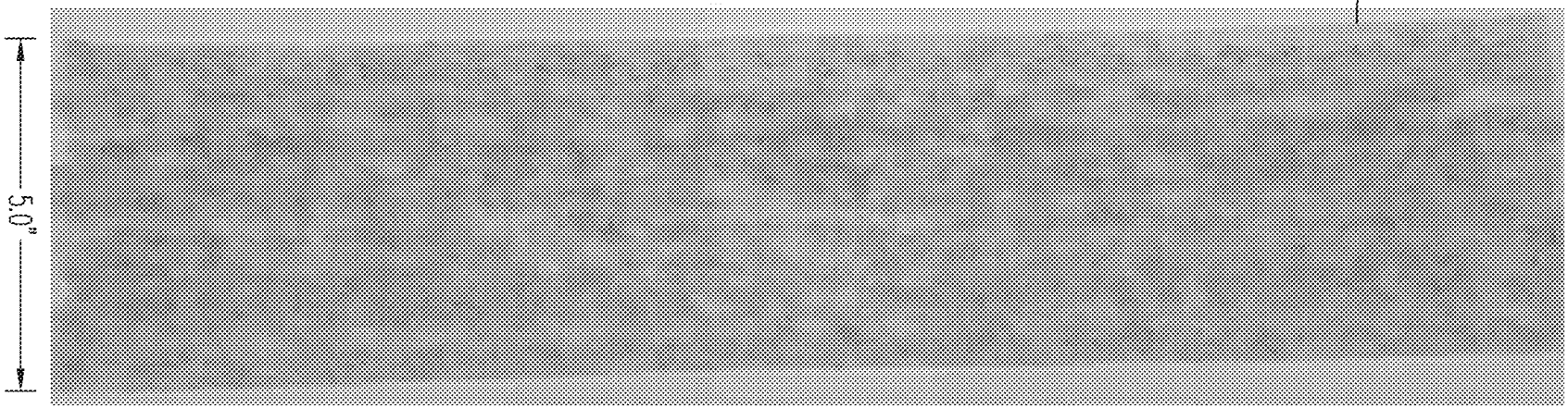
FIG. 9*b* illustrates the floor side of a cleaning fabric after use in the cleaning device of FIG. 6.
Figure 10A:
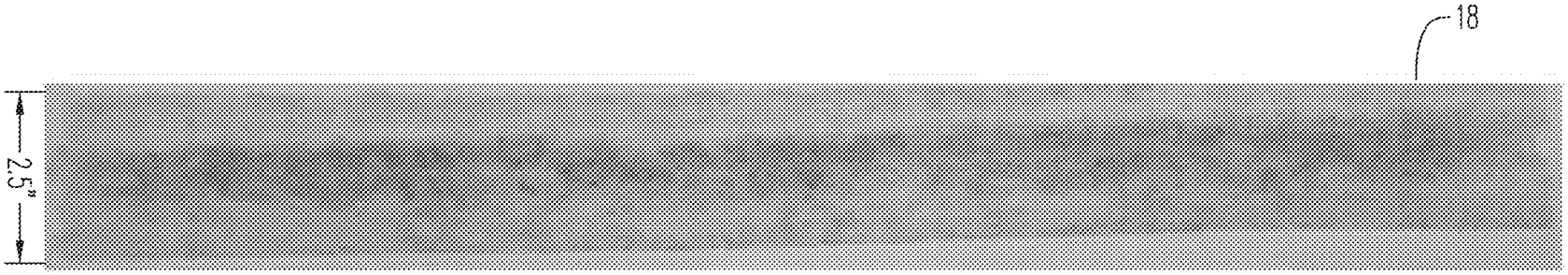
FIG. 10*a* illustrates the device side of a cleaning fabric after use in the cleaning device of FIGS. 7-8.
Figure 10B:
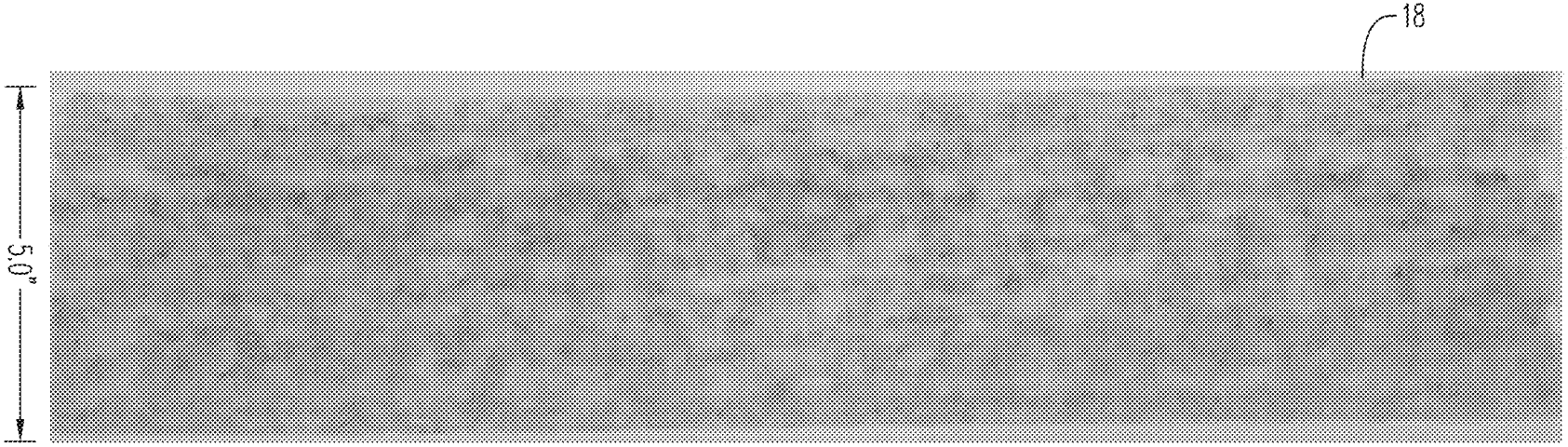
FIG. 10*b* illustrates the device side of a cleaning fabric after use in the cleaning device of FIG. 6.

FIGS. 9*a* and 10*a* are images of fabric 18 after use in device 210, while FIGS. 9*b* and 10*b* are images of fabric 18 after use in prior art device 110. More specifically, FIGS. 9*a* and 9*b* illustrate the debris collected by the side of fabric 18 that was in contact with the test surface for devices 210 and 110, respectively. Conversely. FIGS. 10*a* and 10*b* illustrate the debris collected by the side of fabric 18 that was in contact with the devices 210 and 110, respectively. It can be seen from comparing the FIGS. 9*a*, 9*b*, 10*a*, and 10*b* that device 210 provided cleaning fabric 18 with a higher density of collected debris per unit area than the fabric 18 used with device 110.

Figure 11:
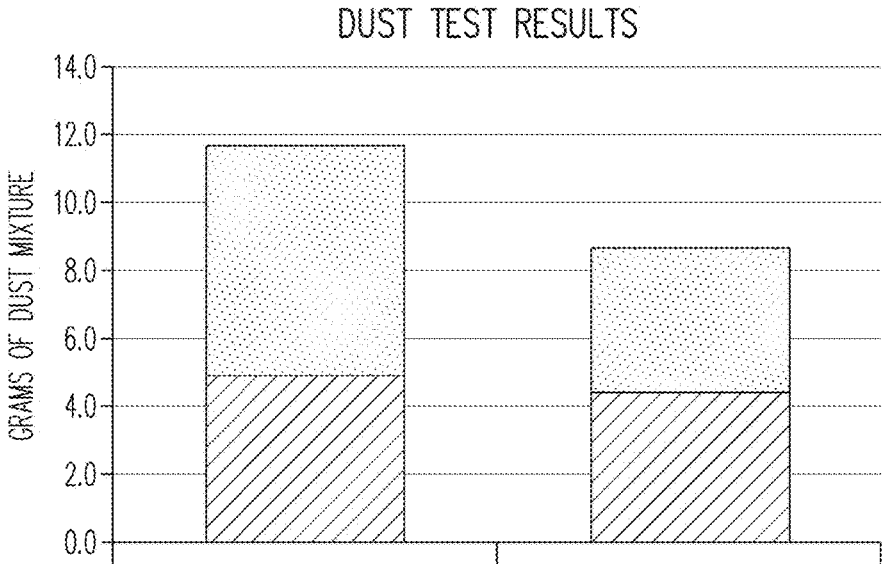
FIG. 11 is a graph comparing the debris collection of the device of FIG. 6 and the device of FIGS. 7-8.

FIG. 11 is a graph comparing the debris collection of the devices 110, 210. Prior art device 110, with fabric 18 having 5" of width, picked up 4.9 grams of debris, pushed 6.7 grams of debris off of the test surface, and left approximately 8.4 grams on the test surface. By comparison, device 210, with fabric 18 having 2.5" of width, picked up 4.4 grams of debris, pushed 4.3 grams of debris off of the test surface, and left approximately 11.3 grams on the test surface.

Importantly, the amount of debris picked up by fabric 18 on device 210 (4.4 grams) was approximately equal to the amount of debris picked up by fabric 18 on device 110 (4.9 grams)—but with only half the width of the fabric. It is believed that fingers 212 of device 210 enhance the ability of fabric 218 to pick up debris.

Again, it should be recognized that fabric 18 is illustrated by way of example only as the 3M™ Easy Trap Duster traps. Of course, it is contemplated by the present disclosure for fabric 18 to be other woven, knit, or non-woven cleaning fabrics—and for such fabrics to have be coated or pretreated with adhesives and/or cleaning chemicals.

Figure 12:
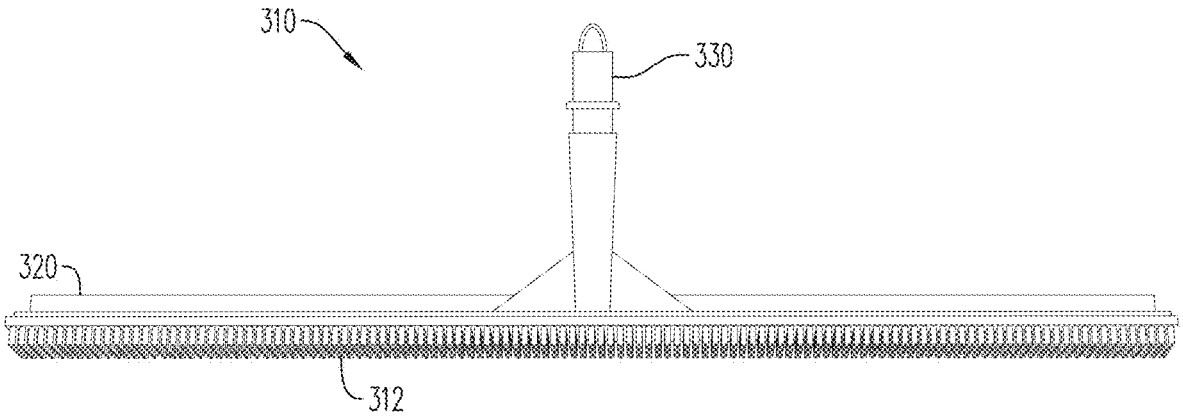
FIG. 12 is a side view of a third alternate exemplary embodiment of a cleaning device according to the present disclosure.
Figure 13:
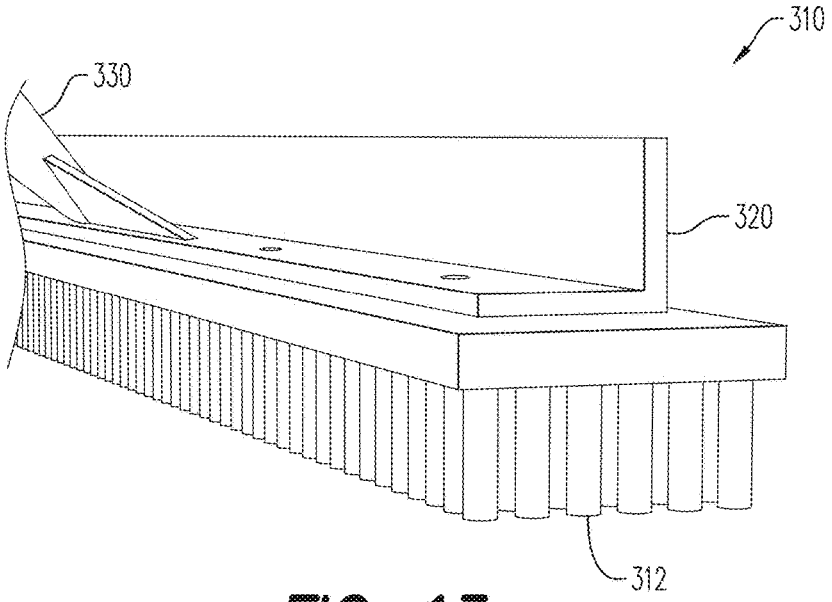
FIG. 13 is a magnified end view of the cleaning device of FIG. 12.
Figure 14:
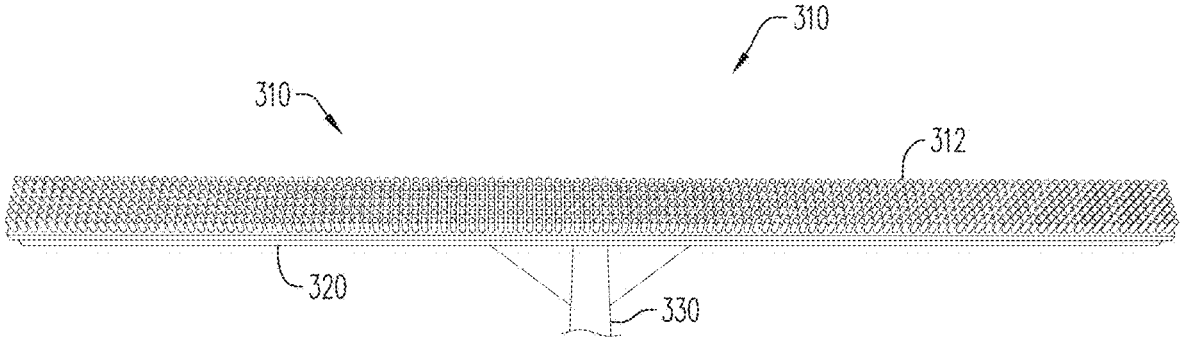
FIG. 14 is a bottom view of a cleaning device of FIG. 12.

Turning now to FIGS. 12-14, another exemplary embodiment of a cleaning device according to the present disclosure is shown and is generally referred to by reference numeral 310. Device 310 includes a single plate 320 having fingers 312 depending therefrom. Device 310 also includes grip 330 to increase the ease of use and movement during cleaning. In some embodiments, plate 320 can be provided with an L-shape or any other desired shape that provides structural rigidity sufficient for its intended use.

Figure 15:
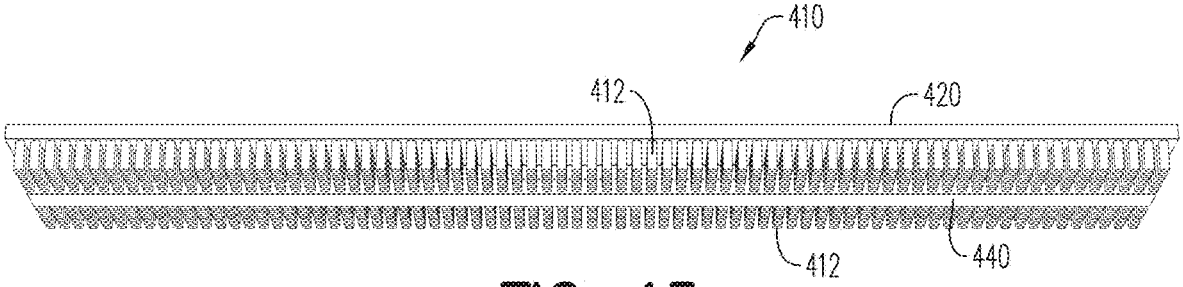
FIG. 15 is a side view of a fourth alternate exemplary embodiment of a cleaning device according to the present disclosure.
Figure 16:
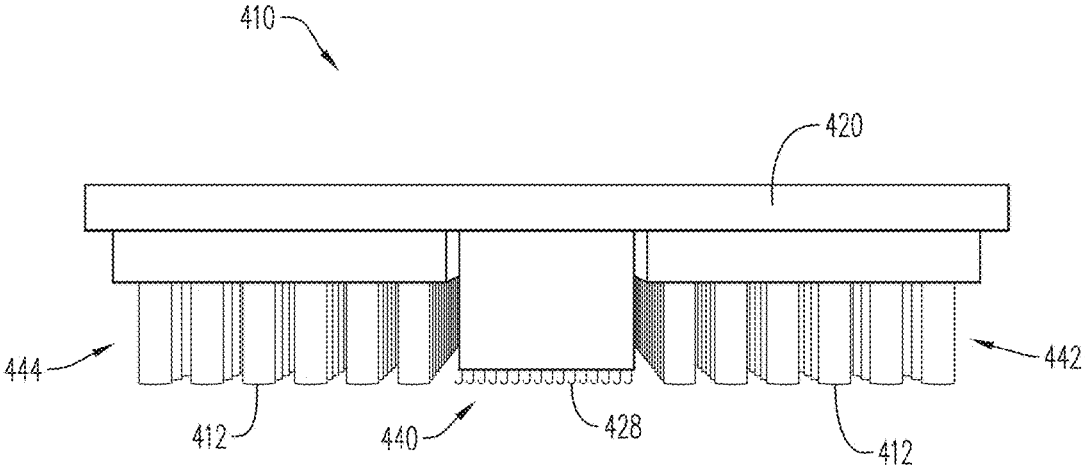
FIG. 16 is a magnified end view of the cleaning device of FIG. 15.
Figure 17:
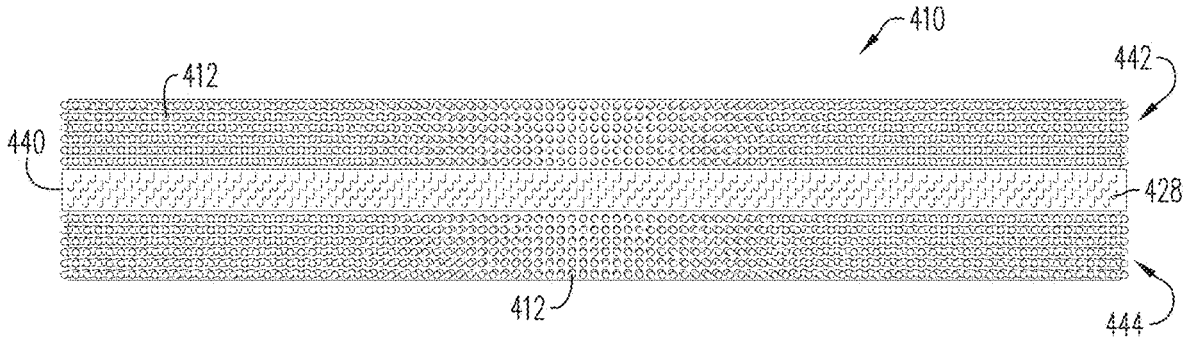
FIG. 17 is a bottom view of a cleaning device of FIG. 15.

Another exemplary embodiment of a cleaning device according to the present disclosure is shown in FIGS. 15-17 and is generally referred to by reference numeral 410. Device 410 includes a single plate 420 having fingers 412 depending therefrom. Device 410 also includes a central wiper 440 that divides fingers 412 into two sections, a front section 442 and a rear section 444. Central wiper 440 can be recessed with respect to fingers 412, can extend past fingers 412, or can be flush with the fingers.

Central wiper 440 can be made of any material having sufficient flexibility and resiliency such as, but not limited to, open celled foam, closed cell foam, thermoplastic elastomer rubber (TPR), thermoplastic elastomer (TPE), gel, polyurethane (PU), natural rubber, silicone, polyvinyl chloride (PVC), and others. In some embodiments, central wiper 440 can have a durometer equal to or greater than that of fingers 412. Thus, central wiper 440 is contemplated by the present disclosure as having a durometer of between Shore OA and Shore 100A, preferably between Shore OA and Shore 80A, and any subranges there between.

In some embodiments, wiper 440 can include a connection member 428 sufficient to grab or secure fabric 18. Connection member 428 can include teeth or spikes molded into or secured to wiper 440 or can be one side of a hook-and-loop type fastener that can grab or secure fabric 18 directly. Hook-and-loop fasteners sufficient for use as connection member 428 can include, but are not limited to, microfiber fabrics, Velcro® brand fasteners that are commercially available from Velcro Industries B.V, and others.

Without wishing to be bound by any particular theory, wiper 440 is believed to provide a stop or barrier to prevent on mitigate the passage of debris through fabric 18. Returning for a moment to the graphs of FIG. 11, prior art device 110 left approximately 8.4 grams on the test surface, while device 210 left approximately 11.3 grams on the test surface. It is believed that wiper 440 reduces the amount of debris that passes through fabric 18 in the direction of cleaning, and which is left on the surface. In this manner, wiper 440 acts as a single elongated finger running perpendicular to the cleaning direction.

In some embodiments, wiper 440 can be formed of or include a hook-and-loop type fastener that can grab or secure fabric 18 directly to the wiper. In some embodiments, wiper 440 is covered with a microfiber cleaning cloth, which acts as one side of the hook-and-loop fastener.

Figure 18:
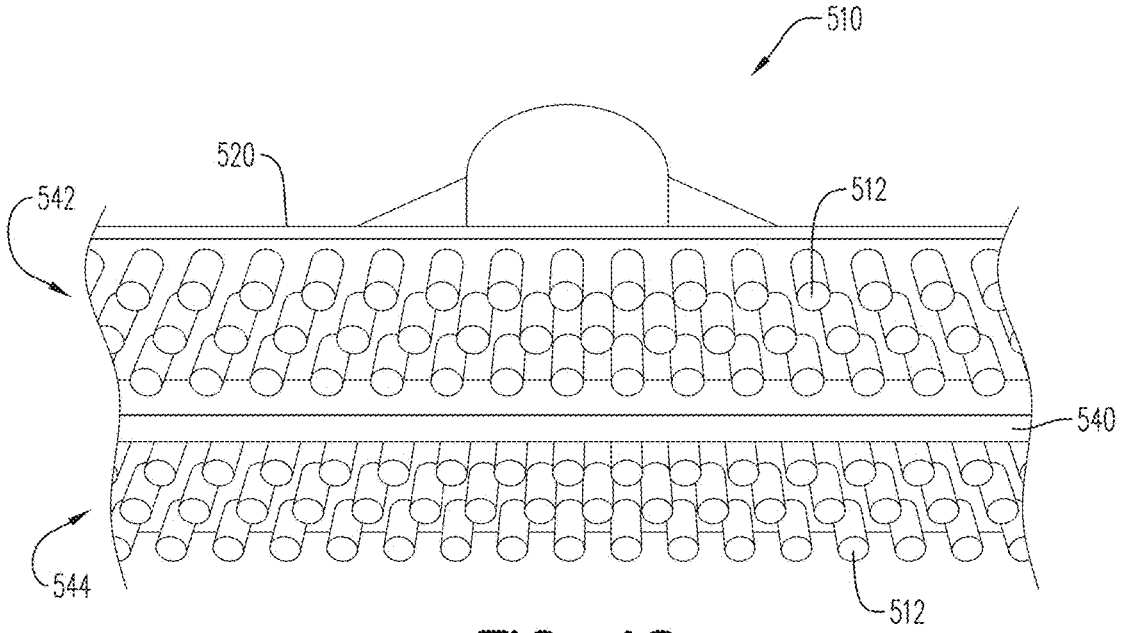
FIG. 18 is a bottom view of a fifth alternate exemplary embodiment of a cleaning device according to the present disclosure.

FIG. 18 illustrates an alternate embodiment of a cleaning device according to the present disclosure and is generally referred to by reference numeral 510. Device 510—much like device 410—includes a single plate 520 having fingers 512 depending therefrom. Device 510 also includes a central wiper 540 that divides fingers 512 into two sections, a front section 542 and a rear section 544.

Figure 19:
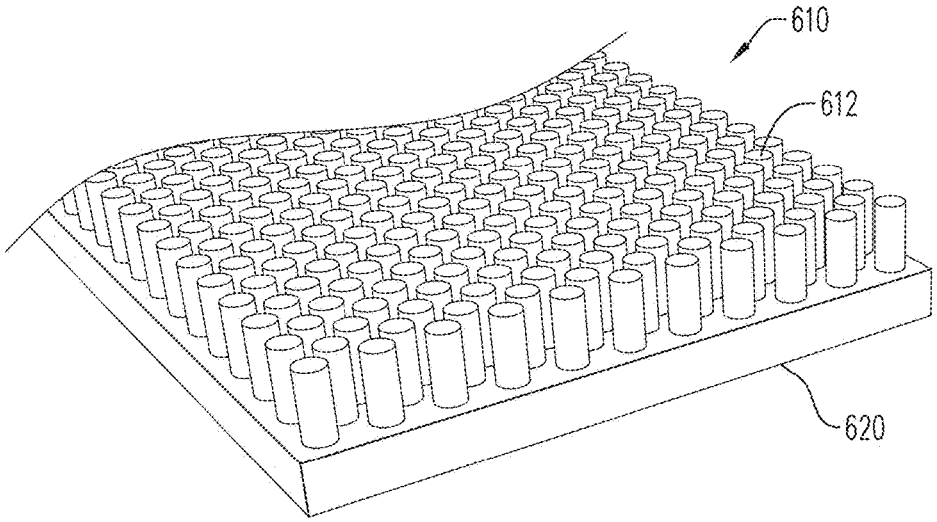
FIG. 19 is a bottom view of a sixth alternate exemplary embodiment of a cleaning device according to the present disclosure.
Figure 20:
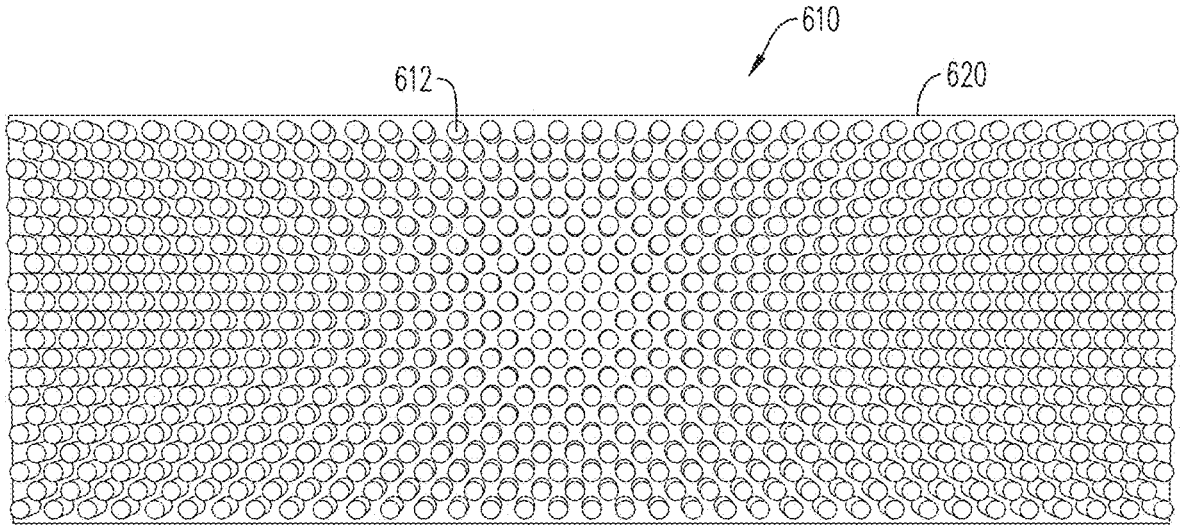
FIG. 20 is a magnified end view of the cleaning device of FIG. 19.
Figure 21:
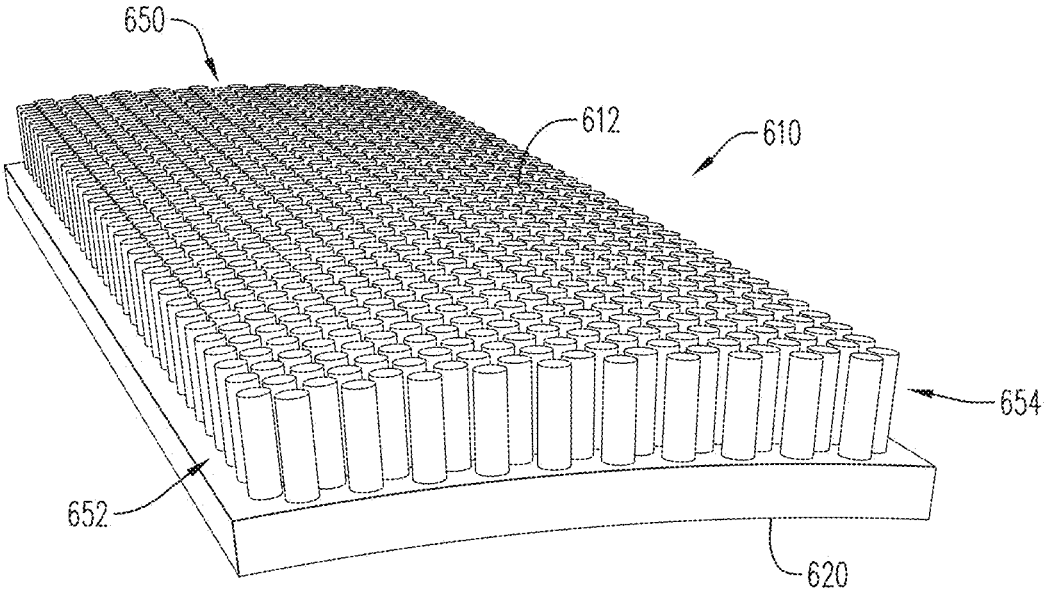
FIG. 21 is a magnified end view of a seventh alternate exemplary embodiment of a cleaning device according to the present disclosure.

Another alternate embodiment of a cleaning device according to the present disclosure is shown in FIGS. 19-21 and is generally referred to by reference numeral 610. Device 610—much like device 10—includes a single plate 620 having fingers 612 depending therefrom but with fingers of shorter and wider dimensions.

In the embodiment of FIG. 21, plate 620 has a convex curvature configured to ensure that device 610 is supported by a central region 650 of fingers, while leaving a gap or space between the cleaning fabric and the surface being cleaned at the leading and trailing edges 652, 654, respectively.

Figure 22:
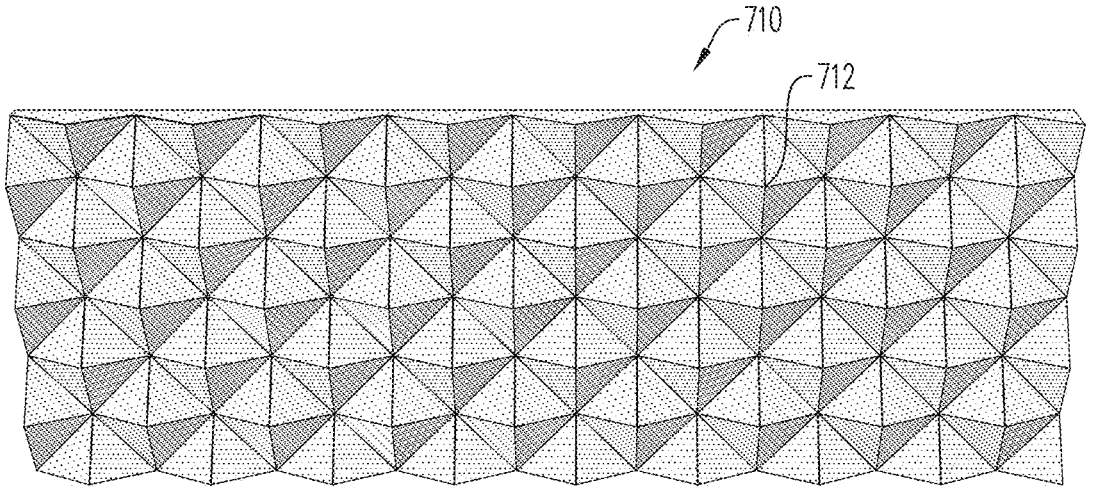
FIG. 22 is a bottom view of an eighth alternate exemplary embodiment of a cleaning device according to the present disclosure.
Figure 23:
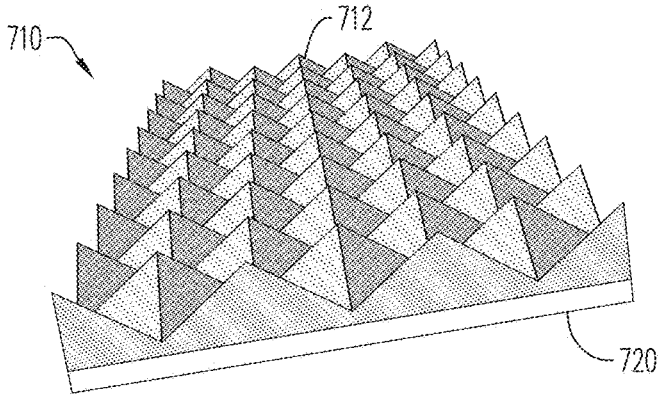
FIG. 23 is a magnified end view of the cleaning device of FIG. 22.
Figure 24:
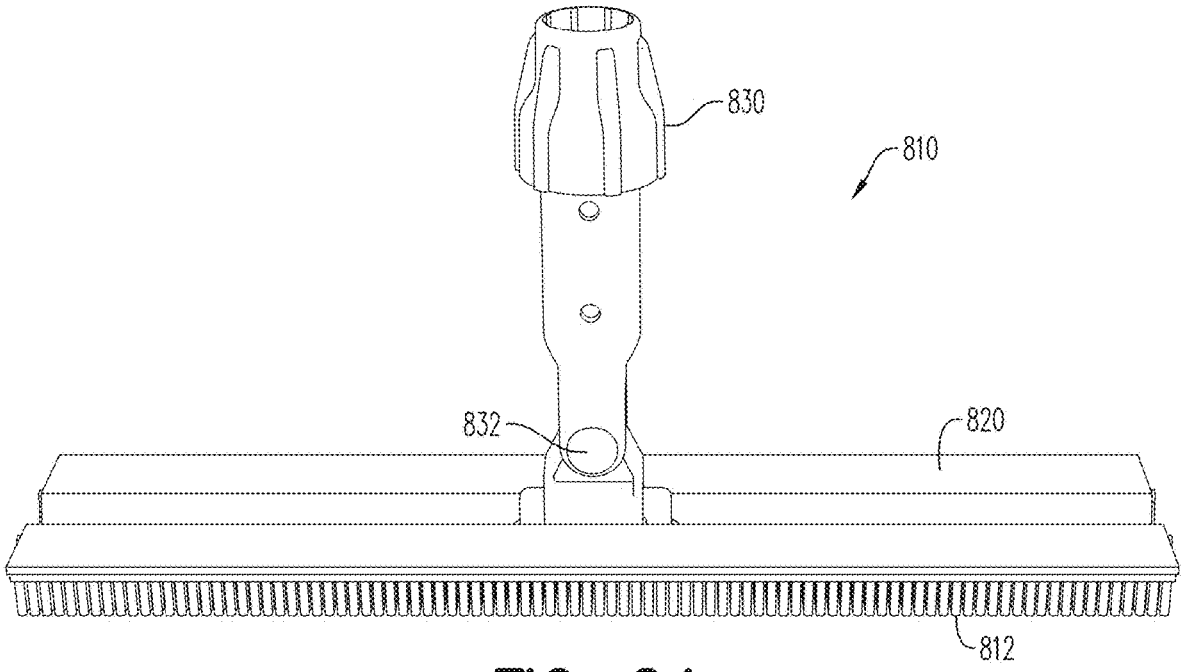
FIG. 24 is a top perspective view of a ninth alternate exemplary embodiment of a cleaning device according to the present disclosure.
Figure 25:
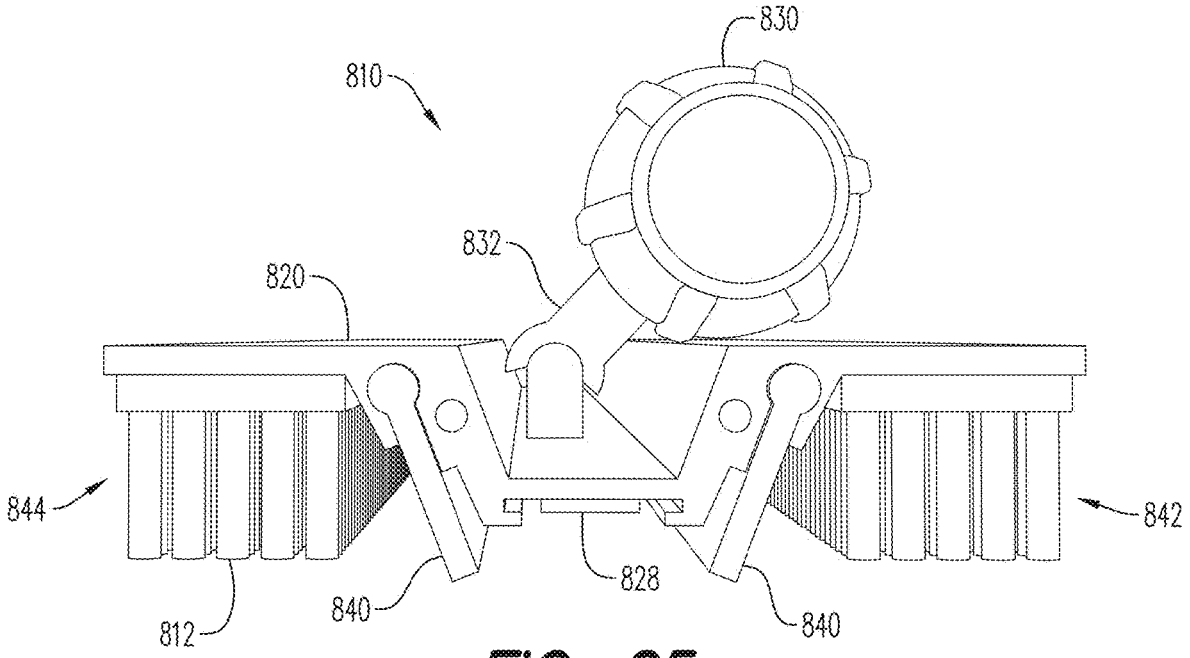
FIG. 25 is a first end view of the cleaning device of FIG. 24.
Figure 26:
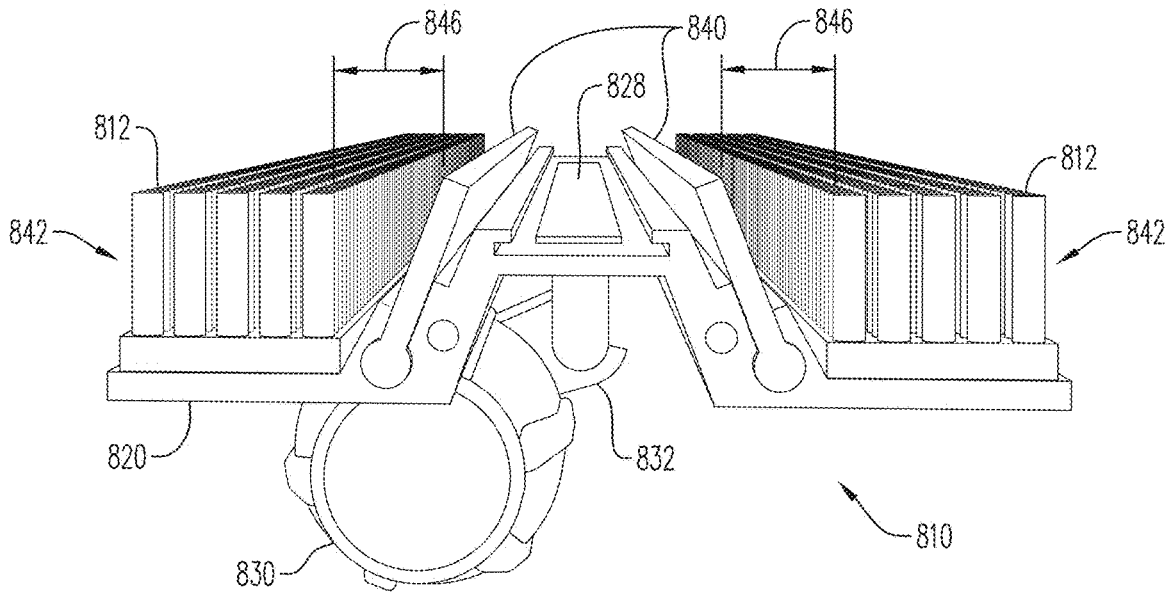
FIG. 26 is a second, opposite end view of the cleaning device of FIG. 24.
Figure 27:
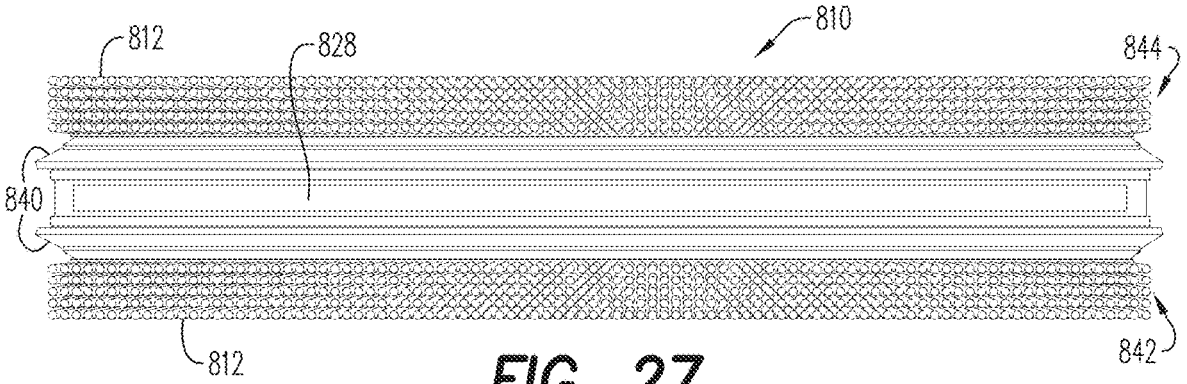
FIG. 27 is a bottom view of the cleaning device of FIG. 24.
Figure 28:
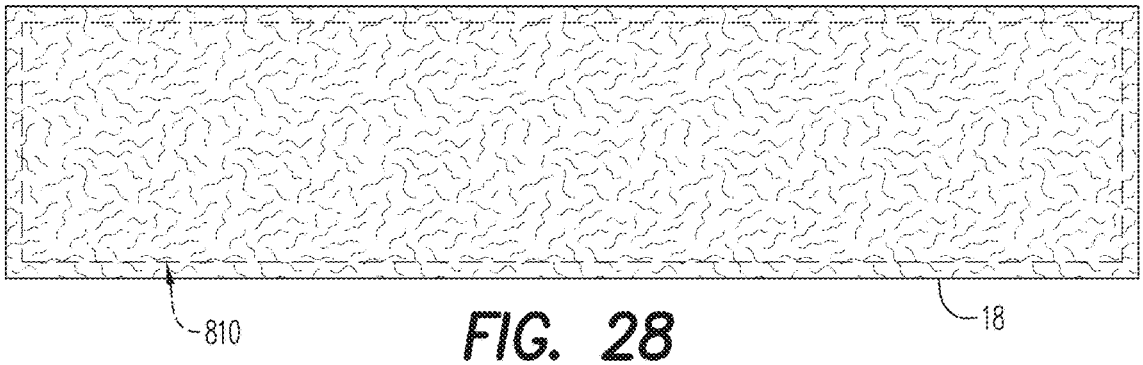
FIG. 28 is a bottom view of the cleaning device of FIG. 24 after connection of a cleaning fabric.

Another alternate embodiment of a cleaning device according to the present disclosure is shown in FIGS. 22-23 and is generally referred to by reference numeral 710. Device 710 includes a single plate 720 having fingers 712 depending therefrom, where the fingers have a shape of a four-pointed star.

Another alternate embodiment of a cleaning device according to the present disclosure is shown in FIGS. 24-28 and is generally referred to by reference numeral 810. Device 810 includes a single plate 820 having fingers 812 depending from one side and a grip 830 and a joint 832 depending from an opposite side.

Device 810 also includes a central wiper assembly that divides fingers 812 into two sections, namely into a front section 842 and a rear section 844. Preferably, the front and rear sections 842, 844 provide device 810 with a symmetrical profile. In the illustrated embodiment, the central wiper assembly includes two wipers 840 and, in some embodiments, a connection member 828 positioned between the wipers. The central wiper assembly or any portion thereof can be recessed with respect to fingers 812, can extend past fingers 812, or can be flush with the fingers. In the illustrated embodiment, wipers 840 extend past fingers 812, while connection member 828 is recessed with respect to the fingers.

Connection member 828 can be any member sufficient to grab or secure fabric 18. Connection member 828 can include teeth or spikes molded into or secured to the wiper assembly and/or device or can be one side of a hook-and-loop type fastener that can grab or secure fabric 18 directly. Hook-and-loop fasteners sufficient for use as connection member 828 can include, but are not limited to, microfiber fabrics, Velcro® brand fasteners that are commercially available from Velcro Industries B.V, and others.

In some embodiments, wipers 840 can be angled with respect to the central wiper assembly. In the illustrated embodiment, wipers 840 are angled inward. Of course, it is contemplated by the present disclosure for wipers 840 to be angled outward, to be angled inward, to be vertical, and any combinations thereof. In the illustrated embodiment, wipers 840 are angled inward with respect to a vertical line by between 5 degrees and 70 degrees, with between 10 degrees and 30 degrees being preferred.

In a preferred embodiment, wiper 840 has a height—prior to deflection—that is at least equal to the height of fingers 812—prior to deflection—and, preferably, has a height that is greater than the height of the fingers. For example, wiper 840 can have an undeflected height that is larger than an undeflected height of fingers 812 by from 0% to 35%, with between 5% and 20% being preferred, with 15% being most preferred.

In some embodiments, wipers 840 can have a durometer equal to or greater than that of fingers 812. Thus, wipers 840 are contemplated by the present disclosure as having a durometer of between Shore OA and Shore 100A, preferably between Shore 20A and Shore 80A, and any subranges there between.

As discussed above and without wishing to be bound by any particular theory, wiper 840 is believed to provide a stop or barrier to prevent or mitigate the passage of debris through fabric 18 by acting as an elongated finger running perpendicular to the cleaning direction as is described in more detail with respect to FIGS. 29-33.

In some embodiments, device 810 includes a debris collection area 846 (FIG. 26) defined between fingers 812 and wiper 840 of both front and rear sections 842, 844.

Figure 29:
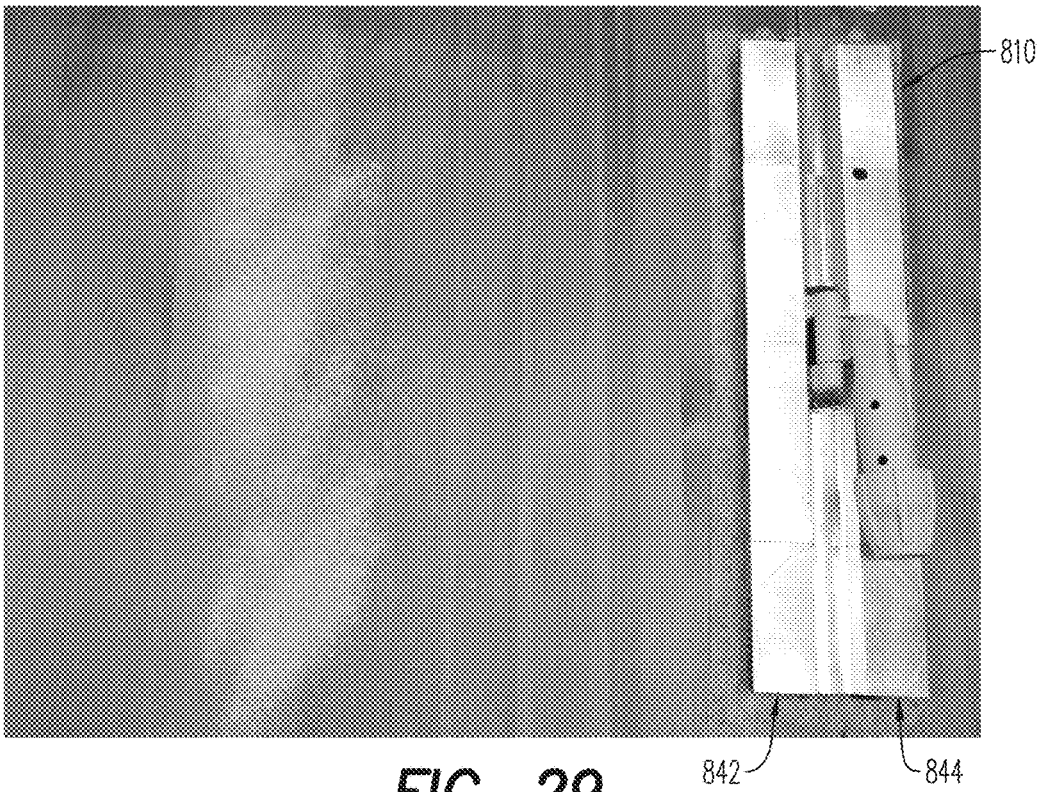
FIG. 29 illustrates the cleaning device of FIG. 24 in use in a cleaning test, but prior to the test.

Device 810 was tested as follows. A test surface consisting of a raised area of vinyl flooring, 48"×96" in dimension, was cleaned and prepared for testing. A predetermined amount of the aforementioned testing debris was prepared and spread onto the cleaned and dried test surface as shown in FIG. 29.

Figure 30:
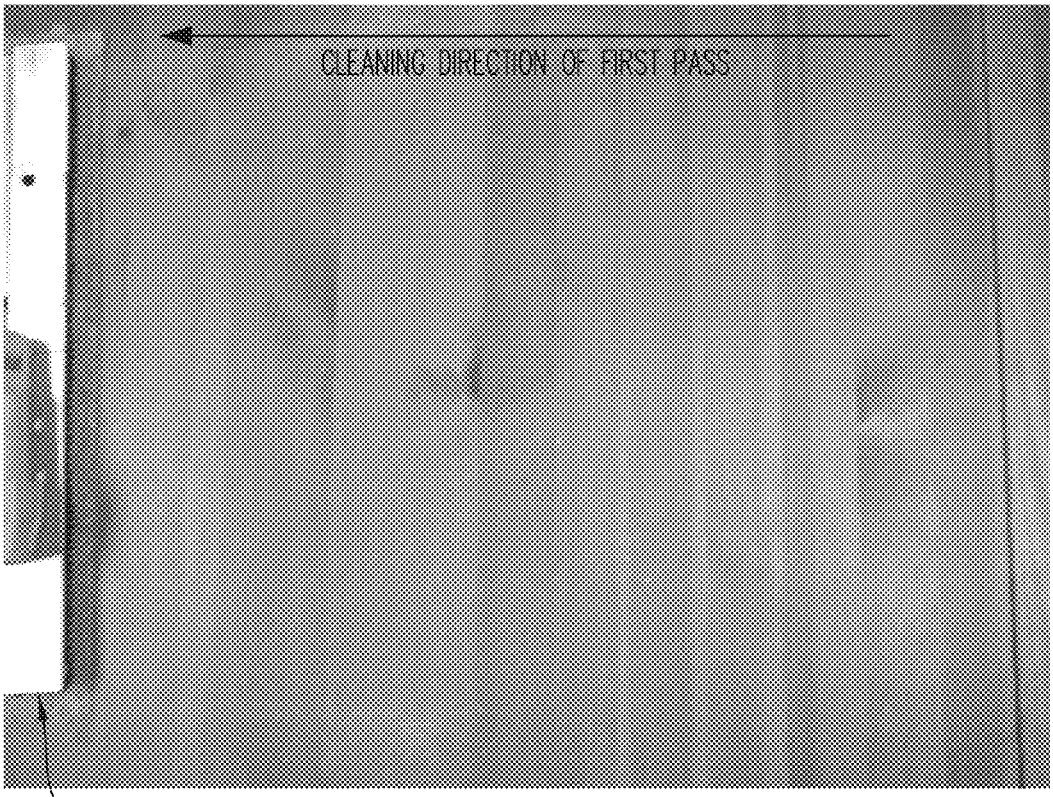
FIG. 30 illustrates the cleaning test of FIG. 29 after a first pass.

Device 810 was placed on the test surface and was moved over the test debris in a first cleaning pass without applying pressure to the device as shown in FIG. 30.

Figure 31:
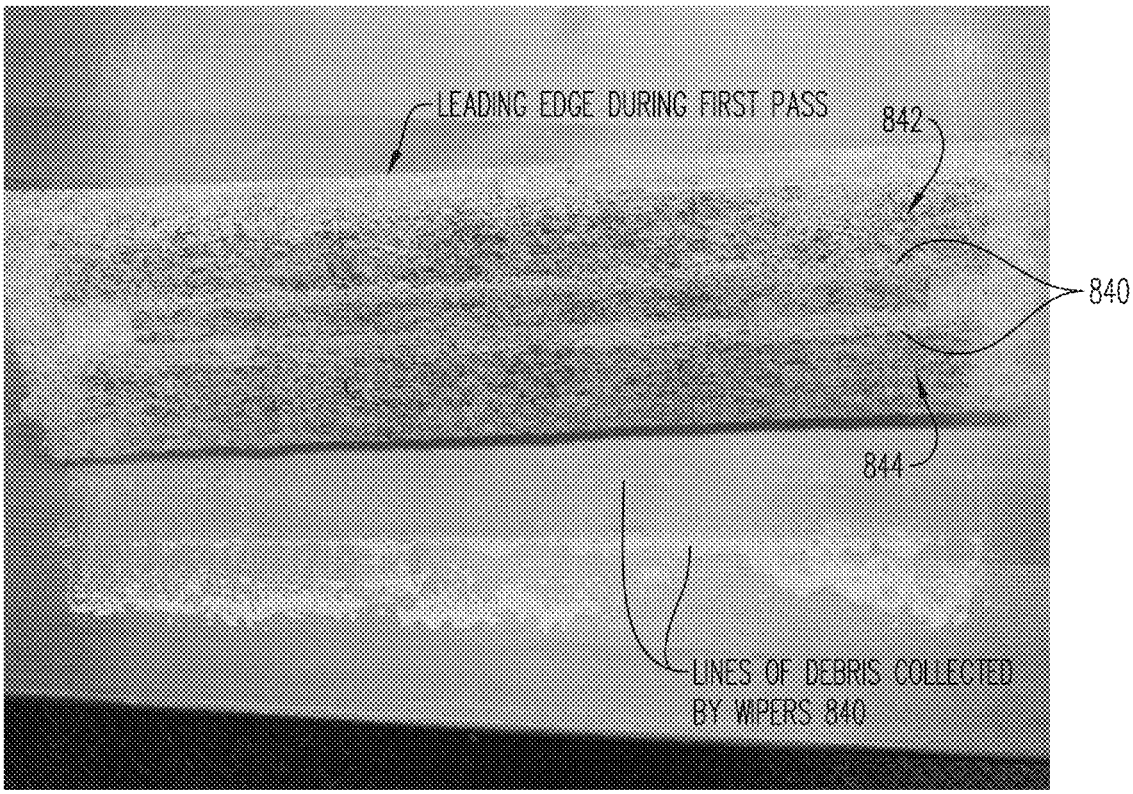
FIG. 31 illustrates the cleaning fabric after the first pass.

After passing over all the debris, the device 810 was tilted as shown in FIG. 31. Here, it can be seen that the leading edge of fabric 18 in the region of front section 842 of fingers 812 has collected debris, as well as the regions of the fabric at wipers 840. Also, it can be seen that debris has not been collected—or only minimally collected in fabric 18 at the region of rear section 844 of fingers 812. Similarly, it can be seen that debris remains on the test surface—in a manner that indicates that wipers 840 are preventing or hindering the passage of debris from front section 842 to rear section 844.

The first pass discussed with respect to FIGS. 30 and 31, can be thought of as representing the results for cleaning as a long continuous movement in a single cleaning direction—such as would occur in a long hallway, gym floor, or other unobstructed area. When cleaning in this single cleaning direction, device 810—as a result of fingers 812 at front region 842 and wipers 840—maximizes the collection of debris in fabric 18 at front region 842, while mitigating or minimizing the collection of debris in fabric 18 at rear region 844.

When performing such a long or single direction cleaning activity, if one were to determine that device 810 was no longer cleaning effectively (e.g., leaving debris on the surface being cleaned), then the user can simply turn device 810 around so that fabric 18 at rear region 844 is facing the cleaning direction. The approach of simply turning device 810 around is in contrast to the method of using prior art devices, which require the user to either replace fabric 18 or flip fabric 18 over on the device.

The first pass discussed with respect to FIGS. 30 and 31, can alternately be thought of as representing the results for cleaning in a first direction of a back-and-forth cleaning movement—such as would occur in smaller areas or areas having obstructions such as would be experienced in a cafeteria setting or hospital patient room setting.

Figure 32:
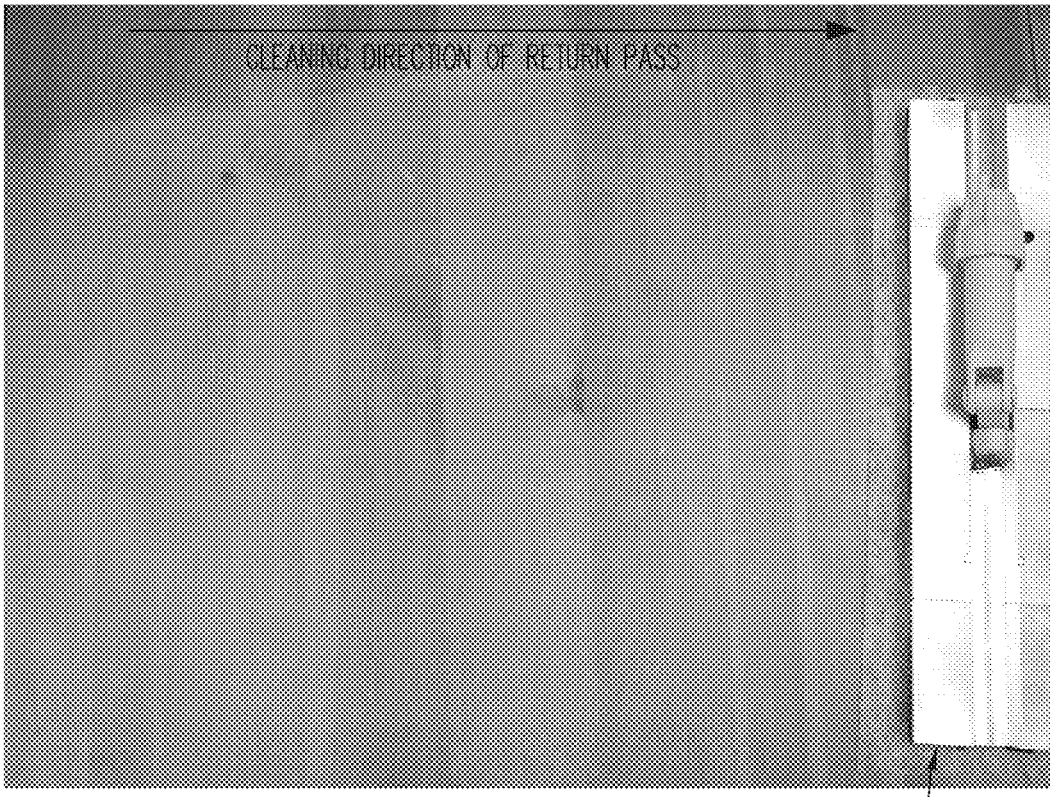
FIG. 32 illustrates the cleaning test of FIG. 29 after a return pass.
Figure 33:
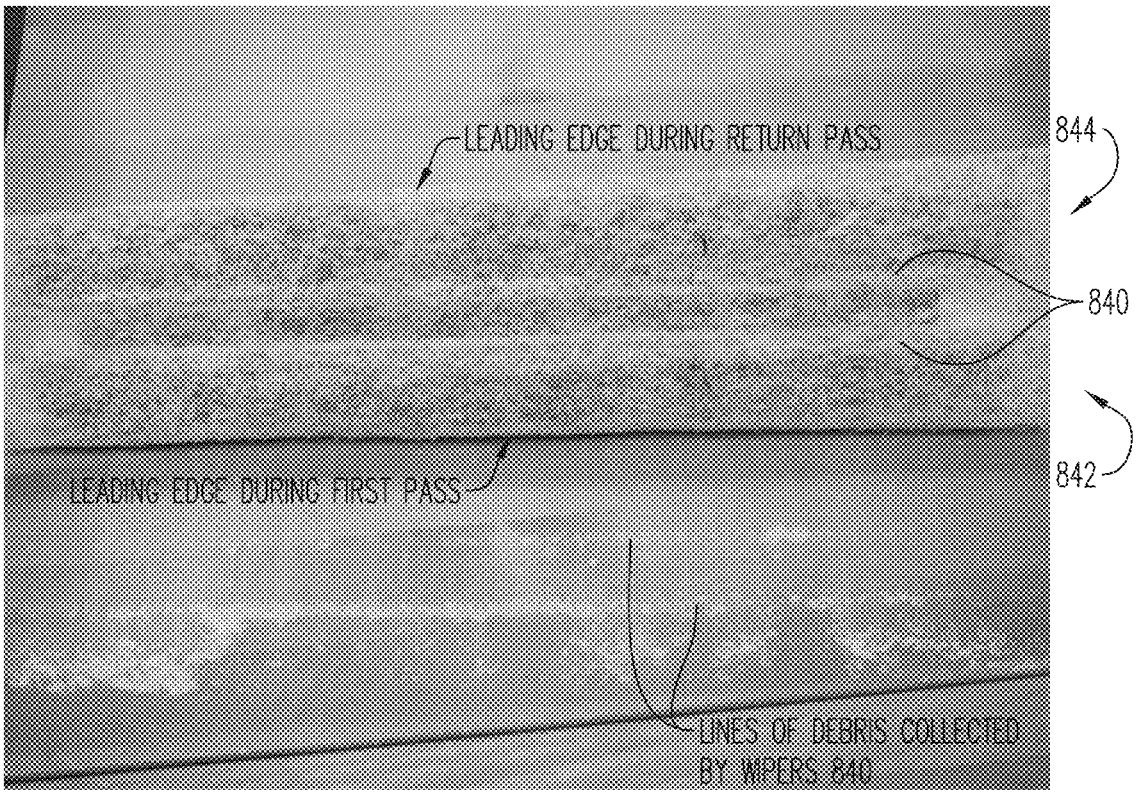
FIG. 33 illustrates the cleaning fabric after the return pass.

Turning now to FIG. 32, this figure is used to illustrate the results of turning device 810 around in the long continuous cleaning movement, while FIG. 33 is used to illustrate the results of moving device 810 in the second direction of the back-and-forth cleaning movement.

Here, device 810 was returned to its position on the test surface and was moved back over the test debris in a return cleaning pass without applying pressure to the device as shown in FIG. 32.

After passing back over all the debris, the device 810 was again tilted as shown in FIG. 33. Here, it can be seen that the leading edge of fabric 18 in the region of rear section 844 of fingers 812 has collected debris, as well as the regions of the fabric at wipers 840. Similarly, it can be seen that debris remains on the test surface—in a manner that indicates that wipers 840 are preventing or hindering the passage of debris from rear section 844 to front section 842.

Without wishing to be bound by any particular theory, device 810 having wipers 840 allow for the prevention or mitigation of debris passing through fabric 18 during movement of the device in a first direction but allow that debris to then be secondarily collected as the device is moved in an opposite direction. Stated another way, device 810 primarily collected debris when moving in the first pass in the region of fabric 18 between wiper 840 and the leading edge of the fabric (i.e., front section 842). Then, device 810 secondarily collects debris in this same area when the device is moved in a second or return pass, while primarily collecting debris when moving in the second or return pass in the region of fabric 18 between the other wiper 840 and the now leading edge of the fabric (i.e., rear section 844).

Figure 34:
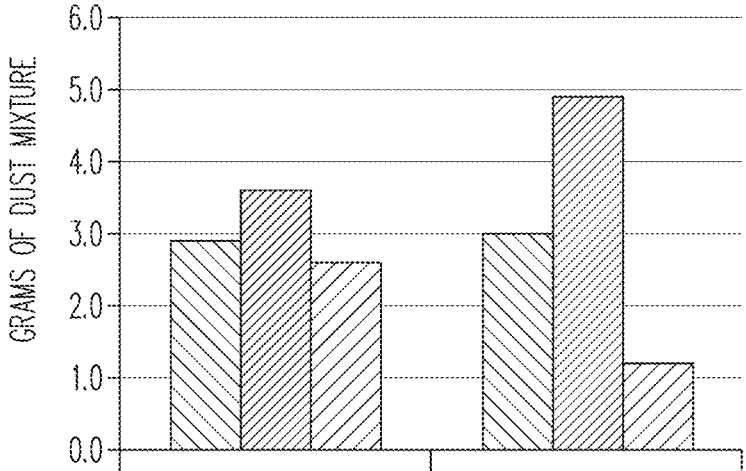
FIG. 34 is a graph comparing the debris collection of the device of FIG. 6 and the device of FIGS. 24-27.

Similar to FIG. 11 discussed above, the debris collection capabilities of the prior art device 110 in FIG. 6 and those of device 810 in FIGS. 24-27 were tested, the results of which are illustrated in FIG. 34.

The same fabric 18, namely the 3M™ Easy Trap Duster traps, was cut to size for each prior art device 110 (i.e., 5"×23") and device 810 (5"×23"), with each fabric being weighed for use in determining the weight of debris collected by the test. Again, it should be recognized that fabric 18 is illustrated by way of example only as the 3M™ Easy Trap Duster traps. Of course, it is contemplated by the present disclosure for fabric 18 to be other woven, knit, or non-woven cleaning fabrics—and for such fabrics to have be coated or pre-treated with adhesives and/or cleaning chemicals.

Devices 110 and 810 were then tested in the same manner discussed above with 9.1 grams of debris mixture being spread onto the cleaned and dried test surface for each device 110, 810. The debris collected in fabric 18 were then weighed for each test, as was the debris that was pushed off of the surface, with the resulting amount of debris being left on the surface being calculated therefrom.

It can be seen from FIG. 34 that device 810 provided cleaning fabric 18 substantially the same amount of collected debris as fabric 18 used with device 110. However, device 840 importantly provided the cleaning surface with a significantly higher amount of debris removed. Furthermore, device 840 is configured for two directional cleaning—with the test illustrated in FIG. 34 being conducted in a single direction.

It should also be noted that the terms "first", "second", "third", "upper", "lower", and the like may be used herein to modify various elements. These modifiers do not imply a spatial, sequential, or hierarchical order to the modified elements unless specifically stated.

While the present disclosure has been described with reference to one or more exemplary embodiments, it will be understood by those skilled in the art that various changes may be made and equivalents may be substituted for elements thereof without departing from the scope of the present disclosure. In addition, many modifications may be made to adapt a particular situation or material to the teachings of the disclosure without departing from the scope thereof. Therefore, it is intended that the present disclosure not be limited to the particular embodiment(s) disclosed as the best mode contemplated, but that the disclosure will include all embodiments falling within the scope hereof.

What is claimed is:

1. A cleaning device for use with a cleaning fabric, comprising:

a plate having a first side and a second side;

a plurality of fingers depending from the first side, the plurality of fingers being configured to provide a gap between the first side and the cleaning fabric during use;

a wiper assembly configured to divide the plurality of fingers into a front section and a rear section, the wiper assembly having one elongated wiper blade for each of the front and rear sections, wherein each elongated wiper blade has a height that is substantially constant along a whole length of the respective elongated wiper blade and wherein said height is at least equal to or greater than a height of the plurality of fingers prior to deflection;

a connection member configured to retain the cleaning fabric to the plate, the connection member arranged on the first side between the elongated wiper blade of the front section and the elongated wiper blade of the rear section; and a grip depending from the second side.

2. The cleaning device of claim 1, wherein the fingers of the plurality of fingers have a durometer between Shore 20A and Shore 90A.

3. The cleaning device of claim 1, wherein the elongated wiper blades have a durometer between Shore OA and Shore 100A.

4. The cleaning device of claim 1, wherein the elongated wiper blades are angled toward each other.

5. The cleaning device of claim 1, wherein the elongated wiper blades are angled inward with respect to a vertical by between 5 degrees and 70 degrees.

6. The cleaning device of claim 1, wherein the elongated wiper blades have an undeflected height that is larger than an undeflected height of the plurality fingers by from 0% to 35%.

7. The cleaning device of claim 6, wherein the connection member is recessed with respect to the undeflected height of the plurality of fingers.

8. The cleaning device of claim 1, further comprising a debris collection area defined between at least one of the plurality of fingers and the elongated wiper blade of the front section and the plurality of fingers and the elongated wiper blade of the rear section.

9. The cleaning device of claim 1, wherein the elongated wiper blades have a durometer equal to or greater than a durometer of the plurality of fingers.

10. The cleaning device of claim 1, wherein the front and rear sections are configured to provide a symmetrical profile to the wiper assembly.

11. The cleaning device of claim 1, wherein the connection member is recessed with respect to an end of the plurality of fingers.

12. The cleaning device of claim 11, wherein the connection member is recessed with respect to an end of the elongated wiper blades.

13. The cleaning device of claim 1, wherein the connection member comprises a plurality of hooks.

14. The cleaning device of claim 11, wherein the elongated wiper blades have a durometer equal to or greater than a durometer of the plurality of fingers.

15. A cleaning device for use with a cleaning fabric, comprising:

a plate having a first side, a second side, a front section, a connection member, and a rear section thereon, the connection member being configured to releasably retain the cleaning fabric to the plate, the front and rear sections each have a plurality of fingers depending from the first side, the front and rear sections being divided by a wiper assembly having one elongated wiper blade depending from the first side for each of the front section and the rear section, and the plurality of fingers and elongated wiper blades being configured to provide a gap between the plate and the cleaning fabric during use, wherein each elongated wiper blade has a height that is substantially constant along its whole length and at least equal to or greater than a height of the plurality of fingers prior to deflection, and wherein the connection member is on the first side between the elongated wiper blades of wiper assembly.

16. The cleaning device of claim 15, wherein the connection member is recessed with respect to at least one of the elongated wiper blades and the plurality of fingers.

17. The cleaning device of claim 15, wherein the elongated wiper blades are angled inward toward the connection member.

18. The cleaning device of claim 15, further comprising a debris collection area defined between at least one of the plurality of fingers and the elongated wiper blade of the front section and the plurality of fingers and the elongated wiper blade of the rear section.

19. The cleaning device of claim 15, wherein the elongated wiper blades have an undeflected height that is larger than an undeflected height of the plurality fingers by from 0% to 35%.

20. The cleaning device of claim 15, wherein at least one of the fingers of the plurality of fingers have a durometer between Shore 20A and Shore 90A and the wiper blades have a durometer between Shore 0A and Shore 100A.

21. The cleaning device of claim 15, wherein the elongated wiper blades have a durometer equal to or greater than a durometer of the plurality of fingers.

22. The cleaning device of claim 15, wherein the elongated wiper blades are angled inward with respect to a vertical by between 5 degrees and 70 degrees.

23. The cleaning device of claim 15, wherein the front and rear sections are configured to provide a symmetrical profile to the wiper assembly.

24. The cleaning device of claim 15, wherein the connection member comprises a plurality of hooks.

* * * * *